US008401772B2

(12) United States Patent
Speiser

(10) Patent No.: US 8,401,772 B2
(45) Date of Patent: Mar. 19, 2013

(54) AUTOMATED ROUTING TO REDUCE CONGESTION

(76) Inventor: Richard David Speiser, Castle Rock, CO (US)

( * ) Notice: Subject to any disclaimer, the term of this patent is extended or adjusted under 35 U.S.C. 154(b) by 215 days.

(21) Appl. No.: 12/824,499

(22) Filed: Jun. 28, 2010

(65) Prior Publication Data

US 2011/0224892 A1 Sep. 15, 2011

Related U.S. Application Data

(60) Provisional application No. 61/313,261, filed on Mar. 12, 2010.

(51) Int. Cl.
*G06G 7/76* (2006.01)
*G08G 1/00* (2006.01)

(52) U.S. Cl. ..... 701/118; 701/23; 701/24; 701/117; 701/119; 340/915; 340/988

(58) Field of Classification Search ..... 701/117–119, 701/400; 340/915–943, 988–996
See application file for complete search history.

(56) References Cited

U.S. PATENT DOCUMENTS

| | | | | |
|---|---|---|---|---|
| 5,108,052 | A | 4/1992 | Malewicki et al. | 246/5 |
| 6,129,025 | A | 10/2000 | Minakami et al. | 104/88.01 |
| 6,249,724 | B1 * | 6/2001 | McCrary | 701/24 |
| 6,263,799 | B1 | 7/2001 | Pardes | 104/28 |
| 6,421,600 | B1 | 7/2002 | Ross | 701/117 |
| 6,532,414 | B2 * | 3/2003 | Mintz | 701/117 |
| 6,708,085 | B2 | 3/2004 | Yamane et al. | 701/1 |
| 7,610,145 | B2 * | 10/2009 | Kantarjiev et al. | 701/527 |
| 2004/0049324 | A1 | 3/2004 | Walker | 701/1 |
| 2008/0071438 | A1 | 3/2008 | Nasr et al. | 701/22 |
| 2009/0125174 | A1 | 5/2009 | Delean | 701/24 |

OTHER PUBLICATIONS

Markoff, John, "Google Cars Drive Themselves, in Traffic," The New York Times News Service, Oct. 9, 2010, 6 pages << retrieved on Oct. 11, 2010 from URL: http://www.thespec.com/news/business/article/266177--google-cars-drive-themselves-in-traffic >>.

Markoff, John, "Self-driving car road-tested," The Denver Post, Section A, Oct. 10, 2010, 1 page.

L. Gordon Crovitz, "The Car of the Future Will Drive You," retrieved on Mar. 13, 2012 from URL: <http://www.online.wsj.com/article/SB10001424052970203986604577257313844244748.html>, dated Mar. 5, 2012; 4 pages.

Brandon, John, "The Smart Car of the Future: Location Aware and Self-Driving," retrieved on Apr. 21, 2011 from URL: <http://www.foxnews.com/scitech/2011/03/25/paving-way-smart-car/?cmpid=cmty_email>; dated Mar. 25, 2011; 3 pages.

(Continued)

*Primary Examiner* — Thomas Tarcza
*Assistant Examiner* — Tyler J Lee
(74) *Attorney, Agent, or Firm* — Merchant & Gould P.C.

(57) ABSTRACT

This disclosure describes embodiments that include systems and methods for integrating various efficient and beneficial transportation and network technologies into an energy-efficient, time-efficient, highly-scalable, semi-public transportation system. Specifically, the disclosed embodiments include methods and systems provide a distributed transportation computing system for routing clean-powered, semi-independent system vehicles within adapted existing metropolitan freeway systems. The embodiments reduce traffic congestion by synchronizing the movements of system vehicles within system roadways. System vehicles may be designed to incorporate clean-power, energy-efficiency, and both on- and off-system operational control. As system vehicles allow for both system and independent use, individuals desiring independence may be incentivized to participate in this semi-public, mass-transportation system. High scalability is possible because modifications to existing freeway infrastructures require minimal retrofitting and simplified expansion in comparison with the construction of presently available mass-transportation systems, such as light rail and subway systems.

20 Claims, 17 Drawing Sheets

OTHER PUBLICATIONS

Plunkett, Chuck, "Could ultra-smart cards leave light rail in the dust?" The Denver Post, Section D, Mar. 7, 2010, 2 pages.

O'Toole, Randall, "Taking the Driver Out of the Car. Why robocars, and not high-speed rail, could revolutionize transportation in the next decade," The Wall Street Journal, Mar. 20, 2010, 3 pages, retrieved from URL: <http://online.wsj.com/article/SB10001424052748703580904575131511589391150.html?> on Mar. 23, 2010.

* cited by examiner

| SPEED | DISTANCE TRAVELED |
|---|---|
| 25 M.P.H | 37 FT PER SEC |
| 35 M.P.H | 52 FT PER SEC |
| 45 M.P.H | 66 FT PER SEC |
| 55 M.P.H | 81 FT PER SEC |
| 65 M.P.H | 96 FT PER SEC |
| 75 M.P.H | 111 FT PER SEC |

AUTOMATED ROUTING TO REDUCE CONGESTION

CROSS-REFERENCE TO RELATED APPLICATIONS

This application claims the benefit of U.S. Provisional Patent Application No. 61/313,261, entitled "SYSTEM OF ROUTING COMPUTER-CONTROLLED CARS FOR REDUCING TRAFFIC CONGESTION," filed on Mar. 12, 2010, the entire disclosure of which is hereby incorporated herein by reference.

BACKGROUND

In recent years, there has been an increased focus on social responsibility, including an emphasis on the evaluation and reduction of an environmental impact, or carbon footprint, associated with various human activities. For instance, there has been a growing interest in "green technologies" for efficiently producing and utilizing energy, in recycling and reusing myriads of products and materials, and in generally conserving natural resources for future generations. In the area of transportation, increased emphasis has been placed on developing and building vast public transportation infrastructures and systems, exploring clean forms of fuel for powering individual vehicles (e.g., electric, solar, and/or hybrid technologies), and promoting the use of more fuel-efficient vehicles.

However, present transportation systems fail to provide an integrated approach, incorporating the multiple benefits of the varied transportation-related developments and green technologies. In addition, improvements in public transportation systems largely fail to provide incentives to individuals who require independence within the system. As a result of increased populations in major metropolitan areas and failures to incentivize individuals to participate in public transportation, traffic congestion remains a significant issue in many cities and urban centers.

Although specific problems have been identified above, the embodiments described herein are not limited to solving the particular problems described. The Background has been drafted merely to provide context for some embodiments. Other embodiments may be useful for solving other problems not specifically described above.

SUMMARY

This disclosure describes embodiments including systems and methods for integrating various efficient and beneficial transportation and network technologies into an energy-efficient, time-efficient, highly-scalable, semi-public transportation system. Embodiments include a distributed transportation computing system for routing vehicles on adapted existing metropolitan freeway systems. Aspects of the methods and computerized systems reduce traffic congestion by synchronizing the movements of vehicles throughout system roadways. Vehicles may be designed to incorporate clean-power, energy-efficiency, and both on- and off-system operational control. As vehicles allow for both independent use and use on system roadways, individuals desiring independence while wishing to gain the efficiencies of operating their vehicles on system roadways may be incentivized to participate in this semi-public, mass-transportation system. High scalability is possible because modifications to existing freeway infrastructures require minimal retrofitting and simplified expansion in comparison with the construction of presently available mass-transportation systems, such as light rail, subway systems, etc.

Embodiments include a method for synchronizing traffic flow thereby reducing traffic congestion within a system roadway. The method includes receiving a route plan request from a vehicle indicating an entry point and a destination and generating one or more route plans based on the entry point and one or more exit points associated with the destination. Further the method includes identifying a top priority route plan of the one or more route plans and a plurality of available route time slots along the top priority route plan. Thereafter, a first feasible route time slot (FFRTS) may be identified from among the plurality of available route time slots. The requesting vehicle may be launched into an actual time slot on a first roadway adjacent to the entry point, wherein the actual time slot corresponds to the first feasible route time slot (FFRTS).

Additional embodiments include a system for synchronizing traffic flow thereby reducing traffic congestion within a system roadway. The system may perform a method, comprising receiving a route plan request from a vehicle indicating an entry point and a destination and generating one or more route plans based on the entry point and one or more exit points associated with the destination. Further, the system may identify a top priority route plan of the one or more route plans and a plurality of available route time slots along the top priority route plan. Further, the system may identify a first feasible route time slot (FFRTS) from among the plurality of available route time slots. The requesting vehicle may be launched into an actual time slot on a first roadway adjacent to the entry point, wherein the actual time slot corresponds to the first feasible route time slot (FFRTS).

Additional embodiments include a computer storage medium, having computer-readable instructions stored thereon for performing a method of synchronizing traffic flow thereby reducing traffic congestion within a system roadway. The method includes receiving a route plan request from a vehicle indicating an entry point and a destination and generating one or more route plans based on the entry point and one or more exit points associated with the destination. Further, a top priority route plan may be identified of the one or more route plans. Thereafter, a plurality of available route time slots may be identified along the top priority route plan and a first feasible route time slot (FFRTS) may be identified from among the plurality of available route time slots. Thereafter, the requesting vehicle may be launched into an actual time slot on a first roadway adjacent to the entry point, wherein the actual time slot corresponds to the first feasible route time slot (FFRTS).

Embodiments disclosed herein may provide methods, systems, and computer storage media for synchronizing traffic flow and thereby reducing traffic congestion within a system roadway. The methods may further comprise receiving a route plan request from a vehicle indicating an entry point and a destination and generating one or more route plans based on the entry point and one or more exit points associated with the destination. Thereafter, the one or more route plans may be prioritized based on a projected travel time from the entry point to the destination and a top priority route plan having the lowest projected travel time may be identified. Thereafter, a plurality of available route time slots may be identified and reserved along the top priority route plan. A first feasible route time slot may be identified that corresponds to an available actual time slot on each roadway along the top priority route plan and that has a lowest projected travel time to the destination. The requesting vehicle may then be launched into an actual time slot on a first roadway adjacent to the entry point, wherein the actual time slot corresponds to the first feasible route time slot. Thereafter, a remainder of the reserved plurality of available route time slots may be released.

These and various other features as well as advantages which characterize the systems and methods described herein will be apparent from a reading of the following detailed description and a review of the associated drawings. Additional features are set forth in the description which follows, and in part will be apparent from the description, or may be learned by practice of the technology. The benefits and features of the technology will be realized and attained by the structure particularly pointed out in the written description and claims herein as well as the appended drawings.

It is to be understood that both the foregoing general description and the following detailed descriptions are illustrative and explanatory and are intended to provide further explanation of the claimed embodiments and is not intended to limit the scope of the claimed embodiment.

BRIEF DESCRIPTION OF THE DRAWINGS

The following drawing figures, which form a part of this application, are illustrative of described technology and are not meant to limit the scope of the claimed embodiments in any manner, which scope shall be based on the claims appended hereto.

FIG. 9A illustrates a first route plan and FIG. 9B illustrates a second route plan.

DETAILED DESCRIPTION

Figure 1:
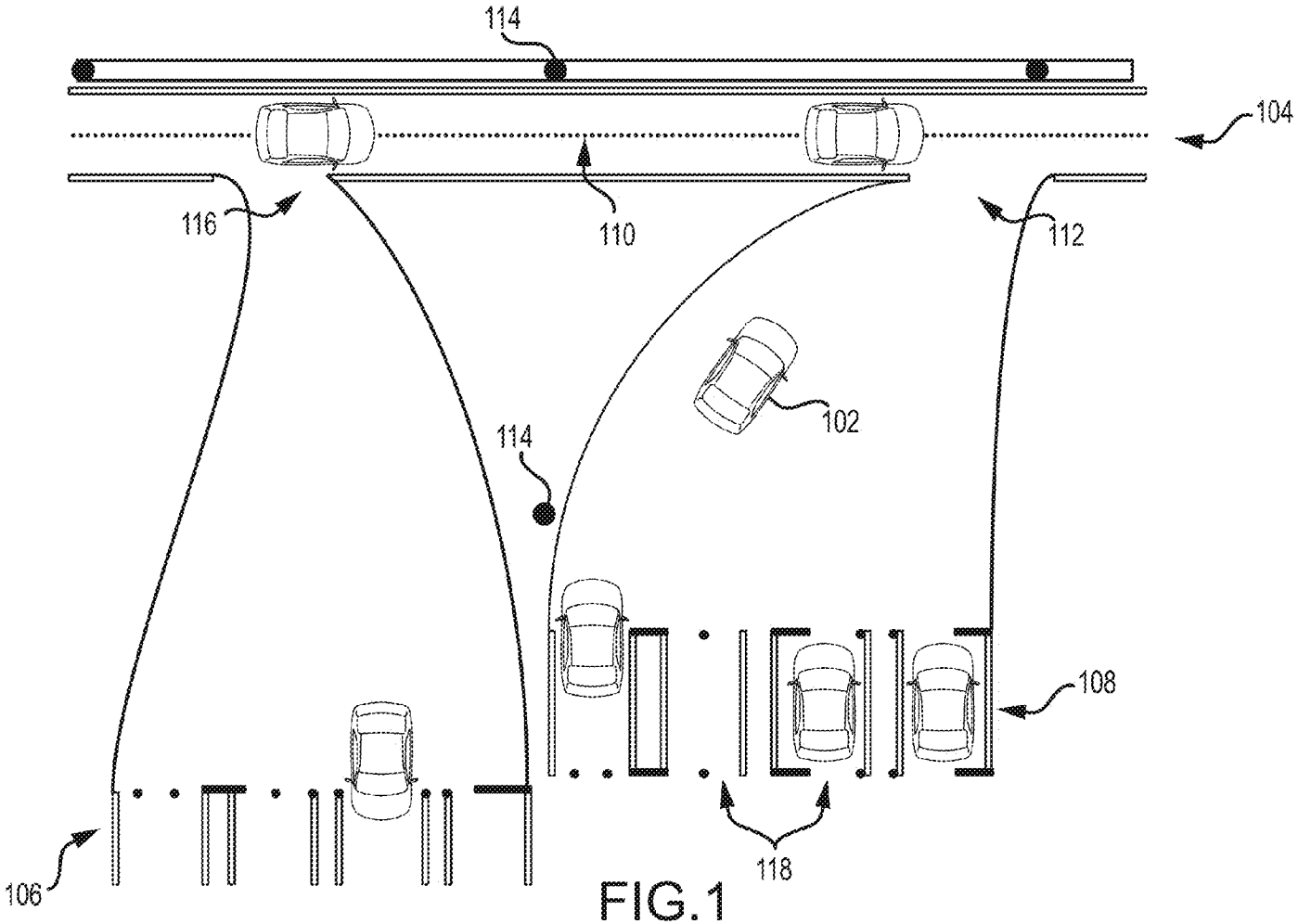
FIG. 1 is a diagram illustrating an embodiment of an integrated mass-transportation system having infrastructure including system vehicles, system roadways, and system entry and exit stations.

Although features of some embodiments introduced above and discussed in detail below may be implemented in a variety of integrated computer systems, the present disclosure will discuss the implementation of these techniques in a computerized mass-transportation system. The reader will understand that the technology described in the context of a computerized mass-transportation system could be adapted for use with other systems, such as computerized routing systems within neighborhoods, airports, theme parks, or other suitable locations. It should be understood that the details provided below, with respect to specific embodiments, are intended merely to provide a description of some embodiments and are not intended to limit implementation of other embodiments.

As noted above, this disclosure describes embodiments including systems and methods for integrating various efficient and beneficial transportation and network technologies into an energy-efficient, time-efficient, highly-scalable, semi-public transportation system. Specifically, this disclosure presents a next generation concept in mass transportation which provides for efficient flow of large numbers of vehicles while also enabling individual control of the same vehicles when they are not on the system. In embodiments, the system can be incorporated into existing transportation infrastructure by using existing roadways or modifying existing roadways with additional equipment. In some embodiments, equipment and infrastructure may be incorporated into exiting highways and legacy vehicles to provide compatibility with new system roadways. In other embodiments, the system may be completely created independent of existing infrastructure.

According to disclosed embodiments, the system may be powered by any viable energy source either presently known or available in the future. For example, system computers and infrastructure may be powered by one or more clean energy sources, such as electricity derived from solar, wind, or other renewable-energy technology. Further, system vehicles (e.g., vehicles utilizing system roadways) may be powered by system electrical power while on system roadways, but may be powered by battery-backup or other independent power source while not on the system roadways. It should be understood that although the use of renewable-energy, including electricity generated using renewable energy sources, is contemplated, embodiments may be powered using energy generated using more traditional energy sources such as hydrocarbons or nuclear materials.

In some embodiments the system requires a vehicle to meet one or more thresholds of performance before allowing the vehicle to use system roadways. As vehicle breakdowns on system roadways can create delays that will affect the efficiency of the system, in some embodiments, the vehicles may undergo diagnostic tests before entering the system roadways to ensure that they are operating properly according to system specifications. As those with skill in the art will appreciate, the diagnostics may test a number of vehicle conditions, including but not limited to a vehicle's emissions (if any), electrical system, fuel system, tire wear, safety system (e.g., restraints, air bags), braking system, etc. Once on the system roadways, central computers may continually monitor the system to determine optimal vehicle entry timing, speed, routing, and exit points. In addition, the system may continue to monitor the vehicle's performance to determine whether the vehicle continually meets performance requirements. In one embodiment, vehicles that are on system roadways that fail to meet performance requirements while en route are forced to exit system roadways.

As described below the vehicles may be configured with additional equipment that allows some features of the embodiments to be implemented. The equipment allows at least some benefits of the embodiments to be realized. As one example, the vehicles may include computers that may be programmed to control a number of functions of the vehicle, e.g., entry onto, exit from, and speed along system roadways. Among other benefits of the disclosed system, individual operators may exercise independence by programming vehicles to a desired destination upon entry or, in the event of an emergency or a change in plans, may use a next-exit function to exit immediately. Individual travelers may further enjoy access to wireless video, voice, and data connections while en route. As system vehicles are controlled by system computers while on system roadways, vehicle operators and passengers may occupy themselves watching TV, listening to the radio, talking on cell phones, or connecting to the Internet, among other things. Unlike other forms of mass transportation, travelers may enjoy the comfort and privacy of their own vehicles while benefitting from the speed, reliability, and environmental responsibility of a public transportation system.

Embodiments Including System Infrastructure

FIG. 1 is a diagram illustrating an embodiment of an integrated mass-transportation system having infrastructure including system vehicles, system roadways, and system entry and exit stations.

As detailed above, the disclosed mass-transportation system includes numerous integrated subsystems and components. Each of the subsystems and/or components will be described in turn. However, it is to be understood that although multiple benefits may be realized by incorporation of all disclosed subsystems and components into an integrated mass-transportation system, embodiments may comprise incorporation of one or more subsets of the disclosed system, i.e., any one subsystem or component or any combination of less than all of the disclosed subsystems or components may be employed within the spirit of the present disclosure.

System Vehicle Embodiments

System vehicles 102 may be new and unique. However, in embodiments, system vehicles 102 may incorporate components used in present vehicles such that they may operate easily and may be compatible with other passenger vehicles while not traveling on the system roadways 104. Further, system vehicles 102 may be designed to meet all current vehicle-safety requirements for passenger vehicles developed now or in the future.

As described above, in embodiments system vehicles 102 may be designed to incorporate clean-power, energy-efficiency, and both on- and off-system operational control. For instance, system vehicles 102 may be designed to be electrically powered both on and off of the system roadways 104. Electric power may be derived via any technology presently known, e.g., wind, solar, nuclear, etc., or developed in the future. In the alternative, system vehicles 102 may incorporate combinations of fuels now known or developed in the future, e.g., hybrid technologies. In addition, according to some embodiments, system vehicles 102 may be powered by system power, either electric or otherwise, while traveling on the system roadways 104 and may be powered independently while traveling off the system roadways, e.g., using current or future vehicle battery or other energy back-up technologies. For example, vehicle batteries may be rechargeable either via plug-in stations at an owner's residence or business, via public plug-in stations, or via power transfer that may occur while system vehicles 102 travel on system roadways 104. According to some embodiments, vehicle design may be developed to optimize speed, size, safety standards, and various customizations, while working within design requirement specifications for operation on the system roadways 104. Design requirements may include the ability to accelerate and brake with local roadway traffic while under control of a vehicle operator and also to accelerate and brake in response to specific commands by central-command computers while on the system roadways 104.

As noted above, system vehicles 102 may in embodiments include on-board computers that communicate with a central computer system involving one or more central-command computers. For example, on-board computers may relay an operator's desired destination to the central computer system for routing. The desired destination may be indicated or selected by a vehicle operator using any suitable mapping application or global positioning system (GPS), for example. In other embodiments, the vehicle operator may have an ability to request an emergency exit, wherein the system may exit the vehicle at the next exit station, e.g., exit station 106. Further, smart sensors may be provided in system roadways 104 that may work in conjunction with the central computer system and/or on-board computers to detect adverse weather or other conditions and to determine routing and/or re-routing in the event of inclement weather, emergency exit requests, accidents, etc.

More specifically, a mapping application or service may provide guidance to a vehicle operator both on and off system roadways 104. For example, upon entering a vehicle, an operator may select or otherwise input a destination into the on-board computer system. The system vehicle 102 may provide the operator with directions to the destination via a visual map route, verbal instructions, or via any other suitable method. Additionally or alternatively, pre-determined routes may be accessed by the operator from the mapping application. If the route selected by the operator includes utilizing system roadways 104, the mapping application may guide the driver to an appropriate entry station, e.g., entry station 108. On-board computers may be in communication with the central-command computers such that when a route is selected, system roadways 104 may be evaluated to determine availability. In the event system roadways 104 are congested or unavailable for the selected route, alternative routes may be suggested to the operator.

According to some embodiments, guidance of system vehicles 102 by on-board guidance systems (e.g. provided by on-board computers) may be configured to track reference signals emitted by road-imbedded cables with redundant overhead reference-signal-emitting cables. For example, system vehicles 102 may monitor the strength of the reference signal between receivers aligned on either side of the transmitting cables in order to guide the vehicle along a system roadway 104. System vehicle direction may be monitored by central-command computers to ensure system vehicles 102 are operating within parameters and to track the location of each vehicle. This information may be collected in a system database to help predict future performance of each system vehicle 102 on the roadway network. An example of predicting system performance may be tracking the battery life or other diagnostic data for a given system vehicle 102.

According to some embodiments, central-command computers may completely control the roadway routing of system vehicles 102 while traveling on system roadways 104. However, central-command computers may release control of system vehicles 102 when the vehicle comes to a complete stop and the vehicle operator makes a decision to regain control of the vehicle, e.g. by initiating a system release button or other suitable release initiator. Thus, once a system vehicle 102 exits from a system roadway 104 and reaches an appropriate exit station 106, the vehicle operator may regain complete control of the system vehicle 102 and the vehicle mapping service may display available routes to an ultimate off-system destination.

System vehicles 102 may further include a number of data connections to a system communications network according to some embodiments. The systems communications network may provide system management and integration, Internet connectivity, voice, and video services, for example. One facet of system management may include a monitoring (or diagnostic) feature wherein the system may run diagnostic tests on each system vehicle 102 to determine whether the vehicle is operating properly and whether the vehicle may enter or remain on the system roadways 104. Data capabilities of system vehicles 102 may further include bandwidth for independent configuration management and control by a remote, central management system. Data connections may also include voice and/or text communications capabilities such that vehicle occupants may be contacted by system personnel and/or automated notification systems in the event of emergencies or otherwise. Internet connections and other wireless communications capabilities may be provided for operator and/or passenger use of personal computers, radio, and/or video devices. For instance, network or cable television support may be provided for available television channels, movies, etc.

Additionally, system vehicles 102 may be equipped with proximity sensors. Proximity sensors may include any suitable sensing device for detecting a physical location of a system vehicle 102 and its proximity to other system vehicles 102 and/or infrastructure of the integrated mass-transportation system. Proximity sensors may be placed on any suitable interior or exterior location on a system vehicle 102 such that relevant proximity data may be collected regarding a relative physical location of the system vehicle 102. Specifically, proximity data regarding a vehicle location in relation to other vehicles traveling on system roadways 104 may be collected and transmitted back to the central-command computers by the proximity sensors. As such, proximity sensors may prevent vehicles from running into one another. That is, if collected proximity data indicates that a collision is imminent with another vehicle or structure, the vehicle on-board computer may respond by bringing the system vehicle 102 to an immediate stop, thereby preventing the collision. Additionally or alternatively, proximity data collected from individual system vehicles may be transmitted to central-command computers in order to calibrate and validate information received by system roadway sensors.

According to some embodiments, non-system vehicles, e.g., legacy vehicles not specifically designed for the disclosed system, may be modified to operate on system roadways 104. For example, non-system vehicles may include presently manufactured hybrid cars and/or compact, energy-efficient cars that meet design and physical specification requirements of the disclosed system. For example, present hybrid or electric vehicles may be modified to operate on electric-powered system roadways 104. Embodiments of the present disclosure may require non-system vehicles to meet additional system design parameters (e.g., weight, communications capabilities, etc.) to allow for configuration management by the central computer system and for operation on system power while traveling on system roadways 104. As described above, non-system vehicles may also be required to pass system certification and/or diagnostic testing before being allowed to enter system roadways 104.

In the case of system or non-system vehicles, each vehicle may be programmed with a unique identification (ID) number to track the vehicle and to maintain performance records according to embodiments. For example, vehicles may continually transmit important vehicle information to central-command computers while on the system roadways 104. Vehicle information may consist of the unique vehicle ID number along with various other data, including for example, vehicle diagnostic data, vehicle entry point location, current location and speed, and the vehicle operator's desired exit location and/or ultimate destination. In some cases, a vehicle owner may desire to selectively permit or deny entry and/or exit points for system roadways 104 to a vehicle operator. For example, a parent may wish to keep a teenage operator within a particular geographic zone around the family home and/or out of a certain area or neighborhood.

As may be appreciated from the above-disclosure, embodiments of system vehicles 102 may be configured with various beneficial energy-efficient and/or other green technologies in combination with various computer-implemented navigational, communications, network, and other suitable technologies. However, the described technologies and features are not to be understood as an exclusive array, as any number of similar suitable technologies and features may be incorporated into system vehicles 102 within the spirit of the present disclosure. Further, the disclosed technologies and features are not to be understood as a necessary array, as any number of the disclosed technologies and features may be appropriately replaced by other suitable technologies without departing from the spirit of the present disclosure. The illustrated embodiments of system vehicles 102 are provided as an example of potentially useful technologies that may be provided within system vehicles 102 to facilitate the integrated mass-transportation system as described herein.

Embodiments Including System Roadways

In embodiments, the design of system roadways 104 may facilitate the use or re-use of current highway infrastructure for accommodating both legacy highway use by conventionally-operated vehicles and system roadway 104 use by system vehicles 102. Use or re-use of the current highway system within metropolitan areas may reduce and control costs and may speed development. An integration of both legacy vehicles and new system vehicles 102 may not be appropriate in all locations but may be considered in the process of developing system roadways 104 in some embodiments. In at least some embodiments, traffic lanes of system roadways 104 may be separated from the legacy highway lanes. For example, system roadways 104 may be constructed in center lane or shoulder areas of current highway systems.

More specifically, according to embodiments, current highway systems may need retrofitting for use as system roadways 104. For example, system roadways 104 in embodiments may require additional infrastructure in the form of ramps, interchanges, entrance/exit stations, and/or loop-backs. Although embodiments may require some expansion of present highways for new system roadways 104, in most cases, additional government property annexation and purchase should not be necessary. Indeed, any additional infrastructure that may be necessary for converting present highways to include embodiments of system roadways 104 should be minimal in comparison with construction of traditional public mass-transportation systems, i.e., light rails, subways, commuter trains, etc. For example, as system vehicles 102 may be guided by the central-command computers and on-board computers, a physical "track" infrastructure should not be necessary in some embodiments for the system roadway 104. Indeed, transfer of electricity from a system power grid may be accomplished by passing embodiments of system vehicles 102 over a series of magnets, thereby generating power within the vehicle without a physical connection to the power grid. The magnets may be installed and maintained during normally scheduled roadway maintenance and repaving operations.

According to at least some embodiments, it may be appropriate to separate system lanes from traditional highway lanes for the safety of both electric car operators and passengers, who may not be in control of the system vehicle 102 while it travels on the system, and the safety of the legacy vehicle operators and passengers. For example, a safety-zone area may be constructed to physically separate legacy highways from new system roadways 104. In addition, central-command computers may be more equipped to anticipate and regulate system roadway availability if all vehicles traveling on system roadways 104 are identified and/or controlled by the central-command computers. However, according to at least some embodiments, addition of system roadway lanes may be primarily provided within median and/or shoulder areas of current highway systems.

According to some embodiments, heavy traffic congestion in some metropolitan areas may necessitate use of parallel lanes in some embodiments to increase the number of vehicles able to travel on system roadways 104. Parallel operations may be run by the central-command computers. The central-command computers may determine a most appropriate lane for a particular vehicle at any one time, may maneuver the vehicle into the most appropriate lane, and may later maneuver the vehicle into another appropriate lane depending on a location of a selected exit station, roadway conditions, the needs of other vehicles, etc. Where expansion of present highway systems is impractical or impossible, system roadway lanes may in embodiments be constructed above present highway systems. Although this type of additional infrastructure may be more costly, it should be appreciated that in congested metropolitan areas having minimal freeway expansion capabilities, any traditional highway and/or public mass-transportation expansion would require additional expense and infrastructure.

System roadways 104 may also in embodiments be configured with system roadway sensors 110. These roadway sensors 110 may be imbedded in system roadways 104, located on various control towers along the roadways, provided within or along overhead communications cables, or in any other suitable location along the system roadways 104. In addition, roadway sensors 110 may be equipped to collect data via any suitable means, e.g., via ultrasound, infrared, or pressure sensitivity, among others. Roadway sensors 110 may be further configured to transmit and/or receive data via wired, wireless, or any other suitable means.

Specifically, system roadway sensors 110 in embodiments may collect data regarding a variety of roadway conditions. For example, roadway sensors 110 may be positioned at regular intervals along the system roadway 104 to capture data regarding environmental conditions on the roadway, traffic congestion, available actual time slots, vehicle spacing, etc. This information may be used by the central-command computers to determine traffic load balancing across the system roadways 104, to schedule the appropriate timing for new vehicles entering the system roadways 104, and to detect any problems that may require re-routing of vehicles.

Regarding traffic patterns and congestion, roadway sensors 110 may support the vehicle routing and guidance system by providing data associated with actual time slots, as will be described further herein. Specifically, roadway sensors 110 may verify that an actual time slot, as defined by the central-command computers, is actually available for a vehicle that is merging onto the system roadway 104 from a highway interchange, an entry station on-ramp, or a loop-back, for example. Although each actual time slot is scheduled by central-command computers, the roadway sensors 110 may ensure that a vehicle is not occupying an actual time slot that the system has designated as available for use. As can be appreciated, roadway sensors 110 may provide particularly useful feedback-loop data for the safe, reliable, and smooth operation of the disclosed roadway system. That is, by providing real-time information to the central-command computers, roadway sensors 110 may enable a comparison of actual traffic flow within actual time slots versus predicted (planned) flow within route time slots, for example.

According to some embodiments, each "actual" time slot may have a unique identifier based on its creation time on a particular roadway. Actual time slots are created by the time slot engine based on, among other things, a speed limit of the particular roadway, vehicle size, buffer zone size, etc. As such, system computers may calculate a precise location of the actual time slot along the particular roadway at any one time. Indeed, according to at least some embodiments, an "actual" time slot may also be referred to as a "roadway" time slot, as each actual time slot is associated with the particular roadway for which it was created. Alternatively, a "route" time slot that is associated with a particular route plan may correspond, or map, to more than one actual time slot along the route. That is, as a route plan may require merging or transitioning from one roadway to another, route time slots may correspond to more than one actual time slot, i.e., a route may require a merge from a first actual time slot on one roadway to a second actual time slot on another roadway.

According to some embodiments, roadway sensors 110 may further provide details regarding the precise location of each system vehicle 102 on the system roadway 104. The central-command computers may then track the flow of the overall traffic and may schedule available actual time slots that a vehicle may occupy when it comes to an entry point, e.g., entry point 112. The central-command computers may also determine when a system vehicle 102 should accelerate to enter the system roadway 104 in order to merge into a designated actual time slot.

System roadways 104 in embodiments may further include one or more ramps for moving system vehicles 102 from one system roadway 104 to another and from entrance/exit stations onto and off of the system roadway 104. System ramps may be smaller in size and may require reduced structural fortification than typical highway ramps because in embodiments system vehicles 102 may be limited to a common weight and size. According to some embodiments, system entry ramps may further be controlled by an actual time slot allocation schedule, or an actual time slot flow, as determined by central-command computers, such that system vehicles 102 may smoothly transition from an entrance station 108 to the system roadway 104. According to other embodiments, system merge ramps may also be controlled by the actual time slot allocation schedule such that system vehicles 102 may smoothly transition from one system roadway 104 to another, for example.

Loop-backs may be included at strategic locations along system roadways 104 to provide system flexibility, e.g., when physical constraints prevent full access to both directions of a system roadway 104, when vehicles need to be re-routed, and/or when a vehicle operator changes the location of a final destination in-route. For example, loop-backs may be constructed to extend above the system's bi-directional roadway lanes.

As previously noted, the disclosed system may include various communications services for system vehicles in some embodiments. The communication services may be provided by any number of suitable communications providers and communications infrastructures. For example, communications services may be provided by the central-command computers, e.g. regarding vehicle diagnostics, routing, etc., or may be provided by third-party provides, e.g., television, Internet, or other communications providers. Communication services may be provided wirelessly, where available, or may be provided by communication antennas 114 that may be strategically located along the system roadways 104. For example, communication antennas 114 may be constructed at standard intervals between opposing lanes of traffic.

As should be appreciated, the benefits of communications services may be multi-faceted. For example, communications services may provide a link between occupants of system vehicles 102 and entertainment services (i.e., video, the Internet, and an audio/video/data connection with the central-command computers). Communications services may also provide a communications link enabling control of system vehicles 102 by the central-command computers. For example, system vehicles 102 may transmit data regarding speed, location, selected destination, and performance to the central-command computers. In return, the central-command computers may transmit information regarding acceleration, braking, route mapping, guidance, and projected time to a selected destination. Commands may be downloaded from the communications antennas 114, for example, to facilitate corrections to acceleration, braking, mapping and/or projected time to destination for an entire system-planned route.

Additionally or alternatively, embodiments may enable system vehicles 102 to travel on system roadways 104 even if communications are lost with the central-command computers. For example, a system vehicle 102 may continue to travel with information downloaded from a command set and may exit the system roadway 104 at the selected exit point, e.g., exit point 116, as understood by the on-board computer, or may exit at a "next exit" point upon selection by a vehicle operator. Further, the proximity sensors, as described above, may prevent system vehicles 102 from colliding and the on-board guidance system may continue to guide vehicles on the system roadway 104 if central-command communications are lost. Additionally, in the event of a total system failure, on-board systems may instruct system vehicles 102 to come to a controlled stop enabling vehicle operators to take control of each vehicle.

Embodiments Including Entry and Exit Stations

According to embodiments, entry stations 108 provide access for system vehicles 102 to system roadways 104. Conversely, exit stations 106 provide egress for system vehicles 102 from the system roadways 104.

The entry stations 108 may in embodiments have multiple bays 118 for admitting new vehicles onto a system roadway 104. The bays 118 may have security arms to prevent access to the system roadways 104 until central-command computers have had time to conduct diagnostics on each vehicle. When central-command computers have completed a successful diagnostic, scheduled a route, obtained operational control of the vehicle, and determined an available actual time slot, the security arm may admit the new vehicle. System roadway communications services (i.e., third-party media and system communications) may be registered each time a system vehicle 102 pulls into the diagnostic station for entry onto the system roadways 104.

In some embodiments, each entry station 108 may have one or more entry points 112. An entry point 112 may refer to the precise location from which a vehicle may be launched onto an adjacent system roadway 104. According to other embodiments, a merger point may refer to the precise point that a vehicle enters an available actual time slot, either when entering a system roadway 104 or when merging from one system roadway 104 to another. According to further embodiments, an exit point 116 may refer to the precise point a vehicle is exited from an actual time slot onto an exit ramp 120.

According to embodiments, the central-command computers may run diagnostics on each system vehicle 102 in order to determine if the vehicle should be allowed on the system. Diagnostics of the vehicle may include information gathered by central-command computers regarding mechanical, electrical, and on-board computer performance. Diagnostics may also include information regarding the unique vehicle identification, destination selections, and communications checks. The central-command computers may also assess accuracy and performance data for the on-board guidance system of each vehicle. The system vehicle 102 should be within specifications for acceleration, braking, engine performance, battery condition, communications capabilities, etc. Vehicle operators and mechanics may have the ability to view a vehicle's performance diagnostic report, but they may not be allowed to alter the report. The results of the diagnostics and any additional statistical information gathered for each system vehicle 102 may be maintained by the central-command computers.

According to some embodiments, once a system vehicle 102 passes diagnostics and a destination has been selected, the operator may relinquish control of the vehicle in order to gain access to the system roadways 104. Once an operator has turned over control of a system vehicle 102 to the central-command computers, the operator may not regain control of the vehicle. If the operator attempts to regain control of the vehicle, the vehicle may be prevented from entering the roadway system. Additionally or alternatively, if central-command computers determine that a system vehicle 102 should be pulled off a system roadway 104 to re-plan a route, or for any other reason, the vehicle may not be allowed to re-enter the system roadways 104 under independent operator control. In that case, the operator may either wait for a re-plan and be merged back onto the system by the central-command computers or the operator may regain control and exit the system, but the vehicle may not be allowed back onto the system roadways 104 under independent control.

According to some embodiments, once under system control, a system vehicle 102 may then be accelerated onto a system roadway 104 at a precise launch time, as determined by the system for efficient traffic operations. According to other embodiments, when a vehicle is not within specifications, it may not be permitted to join the system roadways. Additionally, in the case where a system vehicle 102 arrives at an entry station 108 when all of the actual time slots are occupied, the central-command computers may hold the vehicle at the entry station 108 until an actual time slot becomes available.

According to embodiments, when a nearest exit station (e.g., exit station 106) to the operator's selected destination is reached, the system may in embodiments guide the vehicle off the roadway until vehicle speed is reduced to a stop and the operator may re-engage personal control of the vehicle once the vehicle is released from control by the central-command computers. Thereafter, the vehicle operator may be guided by on-board navigation to the ultimate destination. More specifically, according to some embodiments, the system may calculate a precise exit time for the vehicle and may exit the vehicle from the roadway system as the vehicle's actual time slot passes the exit point 116. Upon successfully exiting the vehicle, the system may then guide the vehicle onto an exit ramp 120 associated with the exit station 106 and may thereafter allow the operator to re-engage control of the vehicle.

Embodiments Including Loop-Backs

Figure 2:
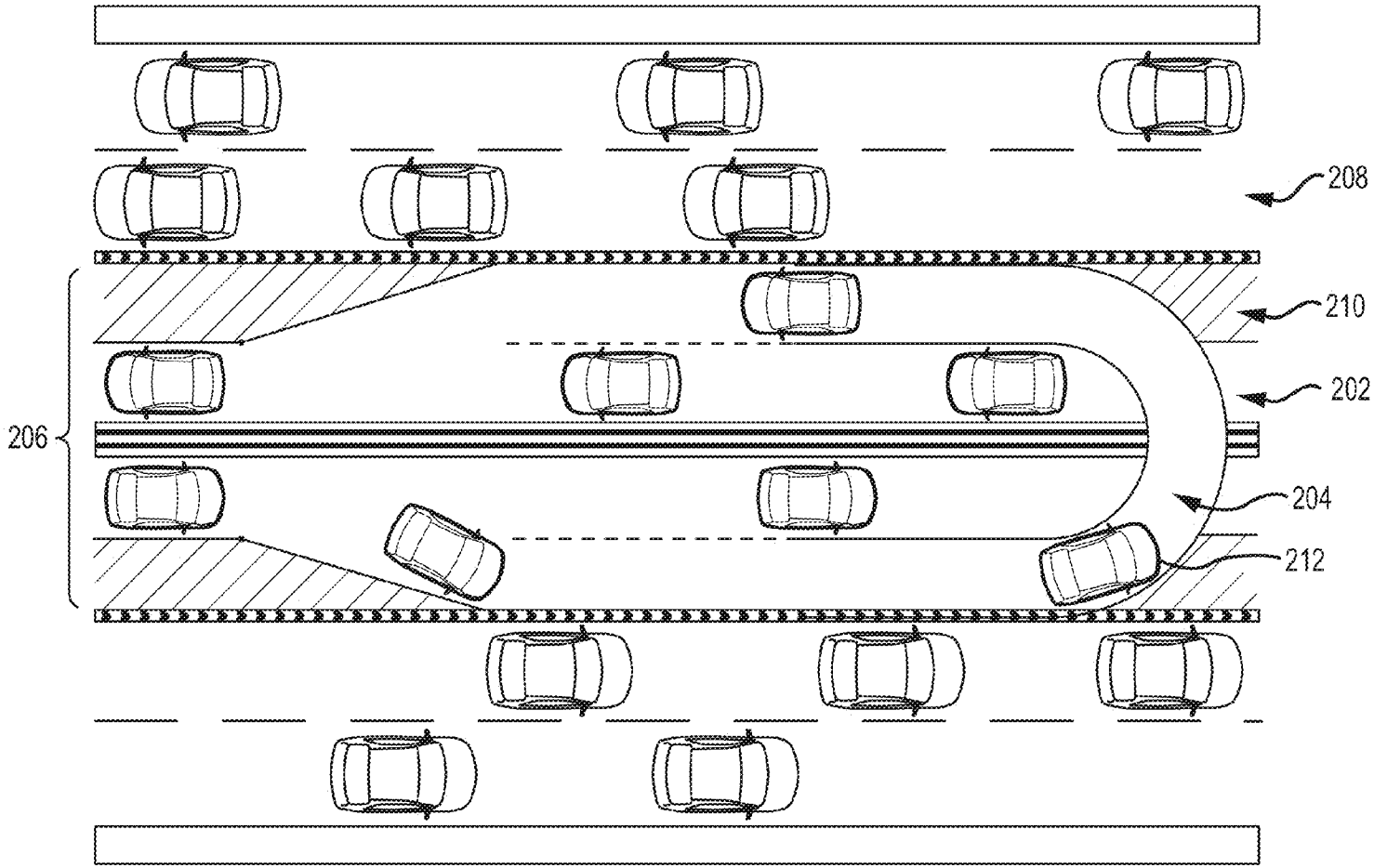
FIG. 2 is a diagram illustrating an embodiment of a system roadway having a loop-back that is constructed within a median area of a traditional highway system.

FIG. 2 is a diagram illustrating an embodiment of a system roadway 202 having a loop-back 204 that is constructed within a median area 206 of a traditional highway system 208.

As described above, embodiments of a system roadway 202 may be constructed in any suitable area within a traditional highway system 208. For example, FIG. 2 illustrates a system roadway 202 constructed in a median area 206 of a traditional highway system 208. In addition, as illustrated, a safety zone 210 may be provided to physically separate system roadways 202 from traditional highway traffic.

According to embodiments, a loop-back 204 may be located at any suitable and logical location along a system roadway 202. For example, loop-backs 204 may be placed between decision point locations, e.g., roadway interchanges, entry/exit stations, etc., to facilitate additional re-direction points. For example, a system vehicle 212 may initially enter the system traveling in an inappropriate direction for a selected exit station, but may be re-routed to an appropriate path by central-command computers by using a next available loop-back. Loop-backs 204 may also provide additional flexibility in the event an operator alters a selected exit point en route and the system must provide an immediate re-route plan. In addition, in the event that central-command computers determine a vehicle should be re-planned and re-directed to cope with a problem, loop-backs provide additional alternatives. For example, problems may include an accident along the route, adverse weather conditions, and/or central-command computers detect a need for traffic load re-balancing across the system roadways 202 for some reason.

Suitable Computer System for Some Embodiments

Figure 3:
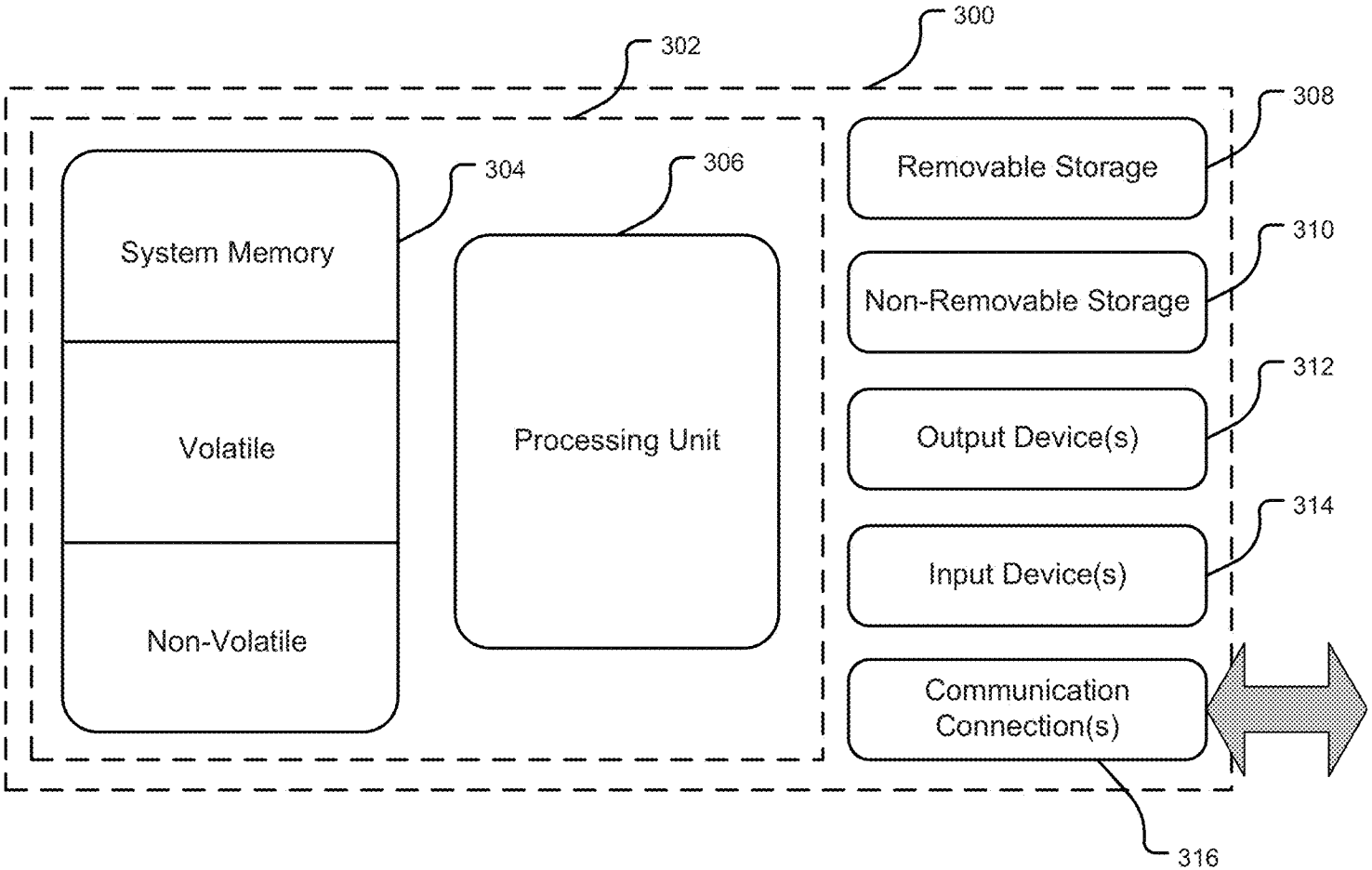
FIG. 3 is a block diagram illustrating an embodiment of a suitable computer system for implementing one or more aspects of the integrated mass-transportation system.

FIG. 3 is a block diagram illustrating an embodiment of a suitable computer system for implementing one or more aspects of the integrated mass-transportation system.

With reference to FIG. 3, a suitable computer system for implementing aspects of an integrated mass-transportation system may include one or more computing devices, such as computing device 300. In general, computing device 300 includes at least one processing unit 306 and memory 304. Depending on the configuration and type of computing device, memory 304 may be volatile (such as RAM), non-volatile (such as ROM, flash memory, etc.), or some combination of the two. A basic configuration of the computing device 300 is illustrated in FIG. 3 by dashed line 302.

Additionally, computing device 300 may also have additional features and/or functionality. For example, computing device 300 may include additional storage (removable and/or non-removable) including, magnetic or optical disks or tape, e.g., removable storage 308 and non-removable storage 310. Computer storage media includes non-transitory, volatile and nonvolatile, removable and non-removable media implemented in any method or technology for storage of information, such as computer-executable instructions, data structures, program modules, or other data. Memory 304, removable storage 308, and non-removable storage 310 are all examples of computer storage media. For example, computer storage media may include RAM, ROM, EEPROM, flash memory or other memory technology, CD-ROM, digital versatile disks (DVD) or other optical storage, magnetic cassettes, magnetic tape, magnetic disk storage or other magnetic storage devices, or any other medium that can be used to store the desired information and can be accessed by computing device 300. The described computer storage media are provided by way of example only and any such suitable computer storage media may be part of computing device 300.

Computing device 300 may also contain communications connection(s) 316 that allow the computing device to communicate with other devices. Communications connection(s) 316 is an example of communication media. Communication media typically embodies computer readable instructions, data structures, program modules or other data in a modulated data signal such as a carrier wave or other transport mechanism and includes any information delivery media. The term "modulated data signal" means a signal that has one or more of its characteristics set or changed in such a manner as to encode information in the signal. For example, communication media may include wired media such as a wired network or direct-wired connection, and wireless media such as acoustic, radio frequency (RF), infrared (IR), and other wireless media. The described communications connections and media are provided by way of example only and any suitable means of communicating between computer systems may be used within the spirit of the present disclosure.

Computing device 300 may also include input device(s) 314 such as a keyboard, mouse, pen, voice input device, touch input device, etc. Output device(s) 312 such as displays, speakers, printer, etc., may also be included.

The computing device 300 may operate in a networked environment using logical connections to one or more remote computing devices (not shown). A remote computing device may include any suitable computer system, such as a personal computer, a server computer system, a router, a network PC, a peer device, or other common network node, and typically includes many or all of the elements described above relative to the computing device 300. The logical connections between the computing device 300 and the remote computer may include a local area network (LAN) or a wide area network (WAN), or any other suitable network. For example, such networks may include enterprise-wide computer networks, intranets, and the Internet.

With reference to a LAN networking environment, the computing device 300 may be connected to the LAN through a network interface or adapter. With reference to a WAN networking environment, the computing device 300 may typically include a modem or other means for establishing communications over the WAN, such as the Internet. The modem, which may be internal or external, may be connected to the processing unit 306 via the communications connection(s) 316, or other suitable mechanism. In a networked environment, program modules or portions thereof, may be stored in a remote memory storage device. For example, a remote application program may reside on a memory device connected to the remote computer. The described network connections are provided by way of example only and any suitable means of establishing a communications link between computer systems may be used.

Communication between components of a central-command computer system may be conducted over a distributed network, as described above, via wired or wireless means. For example, the present methods may be configured as a layer built over the TCP/IP protocol. TCP/IP stands for "Transmission Control Protocol/Internet Protocol" and provides a basic communication language for many local networks (such as intra- or extranets) and is the primary communication language for the Internet. Specifically, TCP/IP is a bi-layer protocol that allows for the transmission of data over a network. The higher layer, or TCP layer, divides a message into smaller packets, which are reassembled by a receiving TCP layer into the original message. The lower layer, or IP layer, handles addressing and routing of packets so that they are properly received at a destination. Again, the described computing device, network functionality, etc., are provided for purposes of example only and any suitable computing system operating over any suitable network other otherwise may be utilized by embodiments as described herein.

Central-command Computer System for Some Embodiments

Figure 4:
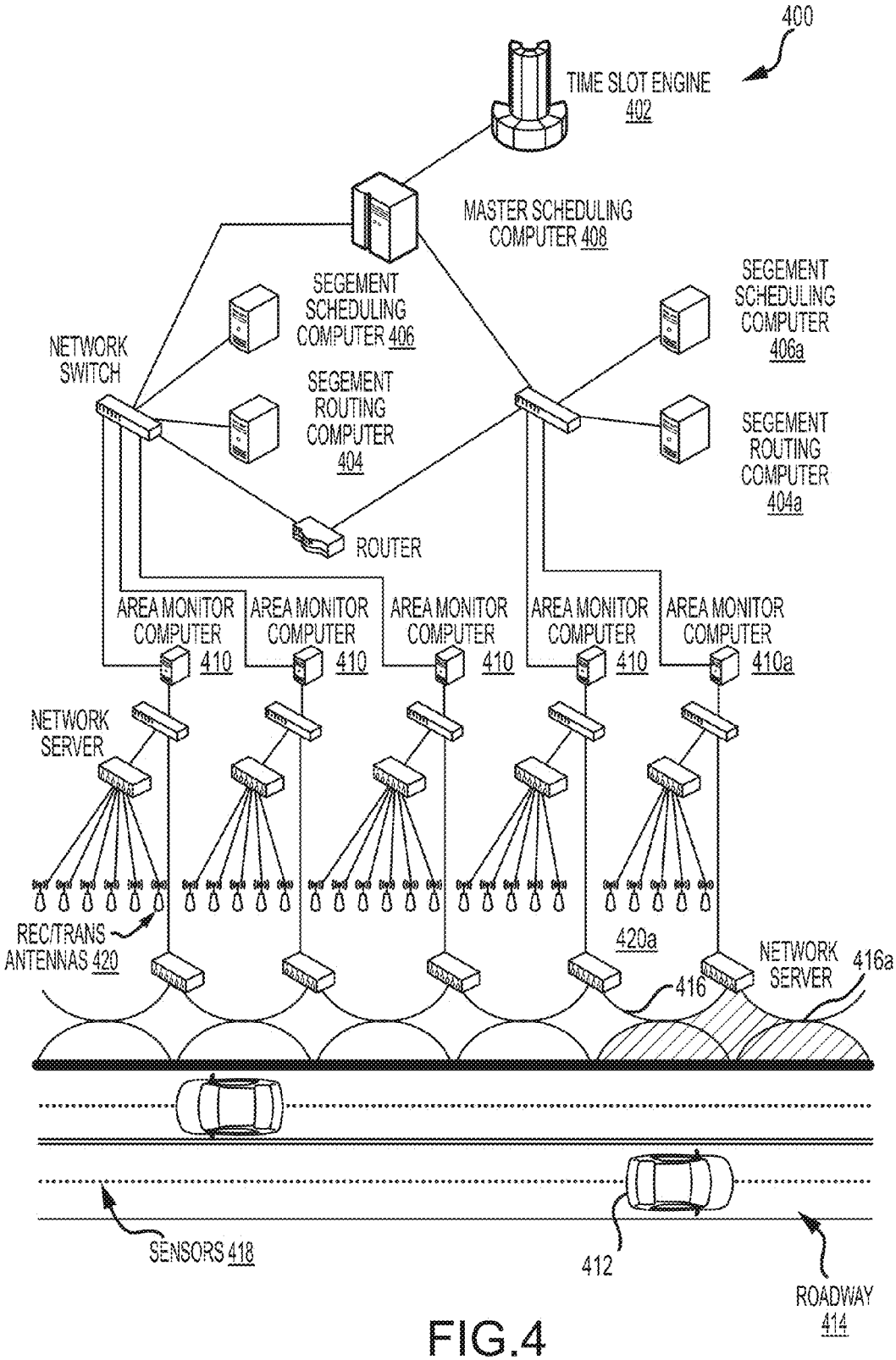
FIG. 4 is an illustration of an embodiment of a central-command computer system for managing the system roadways and for reducing traffic congestion.

FIG. 4 is an illustration of an embodiment of the central-command computer system 400 for managing the system roadways and for reducing traffic congestion.

Embodiments of the present disclosure may depend on distributed, multi-faceted computer systems and/or computing subsystems to provide coordination and management of the diverse aspects of an integrated mass-transportation system. For example, the central-command computer system 400 may include, inter alia, various modules, components, backup systems, storage systems, power systems and subsystems, etc. Specifically, the disclosed central-command computer system 400 may include various specialized computing devices (e.g., computing device 300) such as a time slot engine 402, one or more segment routing computers 404, one or more segment scheduling computers 406, a master scheduling computer 408, and one or more area monitoring computers 410, among others. Indeed, any number of computing systems may be coordinated to provide necessary computing support for the disclosed integrated mass-transportation system. Alternatively, the functions described below with reference to specialized computing systems may be managed by one or more components or modules of a single computing system.

In some embodiments, the central-command computer system 400 may include a time slot engine 402, which creates an actual time slot flow across an entire network of system roadways. Specifically, the time slot engine 402 may facilitate system synchronization for maintaining system performance. A more detailed description of an embodiment utilizing actual time slots for synchronizing vehicles on system roadways is provided below.

In embodiments, the central-command computer system 400 may also include one or more segment routing computers 404 that may build multiple route plans for each vehicle upon request. A local segment routing computer 404*a* may be selected among the one or more segment routing computers 404 based on a location 412 of an entry station along a system roadway 414. In addition, re-plan requests may come through the local segment routing computer 404*a* depending on a location 412 of a vehicle at the time of the request. According to embodiments, the local segment routing computer 404*a* may build an entire route plan for a vehicle entering or requesting within a designated area 416 (or region), regardless of whether the final destination may also be within the designated area 416. For example, when a vehicle pulls into an entry station and moves into position for vehicle diagnostics, a route request may be generated based on information provided by a vehicle operator regarding a desired or selected destination. Multiple route plans may be generated by the local segment routing computer 404*a* based on the entry station and one or more exit stations corresponding to the selected destination. That is, the local segment routing computer 404*a* may take into consideration multiple system roadways and multiple exit stations for generating the multiple route plans. According to one embodiment, three route plans with the lowest estimated travel times and/or the most direct routes to the selected destination may be isolated for further evaluation. As should be appreciated, more or less than three route plans may be isolated for further evaluation and the three route plans are described below for illustrative purposes only.

According to embodiments, the three route plans may then be prioritized such that a top priority is designated for the route plan that projects an earliest arrival time under optimal conditions. In one embodiment, the estimated travel time for the alternate route plans, i.e., the other two route plans, should optimally be within 25 percent of the top priority route plan. If the alternative route plans are within 25 percent of the lowest projected travel time of the top priority route plan the alternative route plans may be designated feasible alternative route plans.

According to some embodiments, a local segment scheduling computer 406*a* of the one or more segment scheduling computers 406 may receive the three route plans from the local segment routing computer 404*a* for evaluation. As with the local segment routing computer 404*a*, the local segment scheduling computer 406*a* may be selected based on the location 412 of a vehicle at the time of the route request, e.g., upon entry or upon a re-route request. Further, the local segment scheduling computer 406*a* may confirm and schedule an entire route for a vehicle entering or requesting within a designated area 416, regardless of whether the final destination may also be within the designated area 416.

As described in more detail below, route time slot availability may be used to verify or confirm the top priority route plan based on current roadway system loading. Preferably, the top priority route plan is evaluated by the local segment scheduling computer 406*a* to ensure available actual time slots exist along the top priority route, based on a projected launch time and an exit point, and upon determining a first feasible route time slot (FFRTS) (which may correspond to one or more available actual time slots along the top priority route) the top priority route plan is confirmed, rendering it an optimal route plan.

In some cases, however, no route time slots may be available along the entire top priority route plan, that is, at one or more merger points along the top priority route actual time slots corresponding to the route time slots are unavailable. In that case, the local segment scheduling computer 406*a* may continue to evaluate the three route plans until route time slots are identified along one or more of the route(s) that are available through an entire route plan. As such, in some cases, even an alternate route plan having a higher estimated travel time than the top priority route plan may be rendered the optimal route plan based on route time slot availability. In the event that none of the route plans present a viable option, i.e., there are no projected route time slots available between the entry station and an exit station near the selected destination, the local segment scheduling computer 406*a* may request the local segment routing computer 404*a* to re-generate route plans for the entry station and the selected destination. Additionally or alternatively, rather than re-generating route plans, the local segment routing computer 404*a* may provide additional route plans of the originally generated multiple route plans to the local segment scheduling computer 406*a* for evaluation, i.e., route plans having higher estimated travel times and/or the less direct routes to the selected destination than the isolated three route plans.

According to some embodiments, upon confirmation of the optimal route plan for a particular vehicle, the local segment scheduling computer 406*a* may be responsible for scheduling the optimal route plan. The local segment scheduling computer 406*a* may further provide each confirmed and scheduled optimal route plan to the master scheduling computer 408, or other centralized database. In addition, the local segment scheduling computer 406*a* may transmit the scheduled optimal route plan to the vehicle and to one or more area monitoring computers 410 distributed along the optimal route. Additionally or alternatively, the local segment scheduling computer 406*a* may be in communication with the one or more area monitoring computers 410 in order to accelerate or slow each vehicle to facilitate efficient synchronization of each vehicle's optimal route plan within the roadway system.

In some embodiments, the master scheduling computer 408 may coordinate the one or more segment scheduling computers 406 for each area and may integrate each vehicle's optimal route plan for the entire system. For example, the local segment scheduling computer 406*a* may in embodiments communicate with the master scheduling computer 408 to find available route time slots when confirming a route plan for a specific vehicle. Once the optimal route plan has been confirmed, the local segment scheduling computer 406*a* may reserve one or more actual time slots for the vehicle, i.e., each actual time slot corresponding to the optimal route time slot along a different roadway of the optimal route. Alternatively, the local segment scheduling computer 406*a* may put a temporary hold on a set of available actual time slots while evaluating the route plan, ensuring that available actual time slots are not scheduled by other segment scheduling computers 406 during evaluation. Thereafter, the local segment scheduling computer 406*a* may release all but the one or more actual time slots corresponding to the optimal route time slot back to the master scheduling computer 408.

In embodiments, one or more area monitoring computers 410 may be responsible for monitoring the system roadway sensors 418 and the performance of the system vehicles. As illustrated, each area monitoring computer 410 may receive data from system roadway sensors 408 (shown) and from other communications infrastructure (not shown) via various receivers/transmitters 420 associated with each area monitoring computer 410 and corresponding to a designated area 416 of the system roadway 414. For example, a local area monitoring computer 410*a* may refer to an area monitoring computer 410 responsible for the designated area 416 in which a vehicle is traveling at any one time. As discussed above, the local area monitoring computer 410*a* may also refer to an area monitoring computer 410 responsible for a designated area 416 in which a vehicle requests entry and/or a re-route plan. According to embodiments, each area monitoring computer 410 may receive data from each vehicle as the vehicle travels through the designated area 416. As should be appreciated, a transition zone may be provided from one area monitoring computer to the next to ensure smooth, efficient, and accurate monitoring of vehicles as they move from one designated area to another along the system roadway 414. Transitioning will be further described below with reference to FIG. 5.

According to some embodiments, each area monitoring computer 410 may monitor the progress of individual vehicles on the system roadway 414 and may validate available actual time slots as vehicles flow through each designated area 416. According to some embodiments, in the event a projected available route time slot is already occupied by another vehicle, an area monitoring computer 410 may not launch the vehicle into the unavailable actual time slot, but may immediately request a re-route plan from a local segment routing computer 404*a* responsible for the designated area 416 of the system roadway 414. According to other embodiments, in the event a projected available route time slot is already occupied by another vehicle, a local area monitoring computer 410*a* may cause the vehicle projected to occupy the unavailable actual time slot to pull off the system roadway 414. For example, this situation may potentially occur when a vehicle is projected to merge from one roadway to another roadway within the system. The local area monitoring computer 410*a* may then request a re-route plan for that vehicle from the local segment routing computer 404*a*.

Area monitoring computers 410 may in embodiments also be responsible for managing the movement of each vehicle, e.g., for commanding vehicles to accelerate, decelerate, or come to a stop. Thus the one or more area monitoring computers 410 may maintain the traffic flow within a designated area 416 of a system roadway 414. Since the area monitoring computers 410 may transition vehicles from one designated area 416 of a system roadway 414 to another, the area monitoring computers 410 may continuously communicate with one another regarding traffic flow, load balancing, and individual vehicle performance. In addition, the one or more area monitoring computers 410 may monitor the guidance directions downloaded to the vehicle as each decision point is reached along an optimal route.

In some embodiments, when a vehicle reaches a planned exit point at an exit station, based on the optimal route plan, a local area monitoring computer 410*a* may exit the vehicle and guide it off the system roadway 414 to the exit station. When the vehicle enters the exit bay, it may be brought to a complete stop by the local area monitoring computer 410*a*. Thereafter, the vehicle operator may regain control of the vehicle from the central-command computer system 400. Additionally or alternatively, upon exiting the vehicle from a system roadway 414, the local area monitoring computer 410*a* may archive projected vs. actual route information and projected vs. actual travel time for the vehicle.

By way of general overview, the various computing systems and subsystems of the central-command computer system 400 may provide various navigational, routing, monitoring, and other management functions within the disclosed integrated system. As described above, system computers may operate within a distributed computing network. Additionally, the system computers may interact at various levels with system vehicles and operators traveling on system roadways 414. As should be appreciated, the various functions and aspects of the central-command computer system 400 described below may be performed by any combination or subset of the specialized computers described above. Thus, the described specialized computers are not to be understood as an exclusive array, as any number of similar suitable specialized computers or subsystems may be incorporated into the system 400 within the spirit of the present disclosure. Further, the disclosed specialized computers are not to be understood as a necessary array, as any number of the disclosed specialized computers may be appropriately replaced by other similar suitable specialized computers or subsystems without departing from the spirit of the present disclosure. The illustrated embodiments of a central-command computing system 400 are provided as an example of potentially useful technologies that may be provided within the disclosed system 400 to facilitate the integrated mass-transportation system as described herein.

Vehicle Routing Management and Synchronization Embodiments

Figure 5:
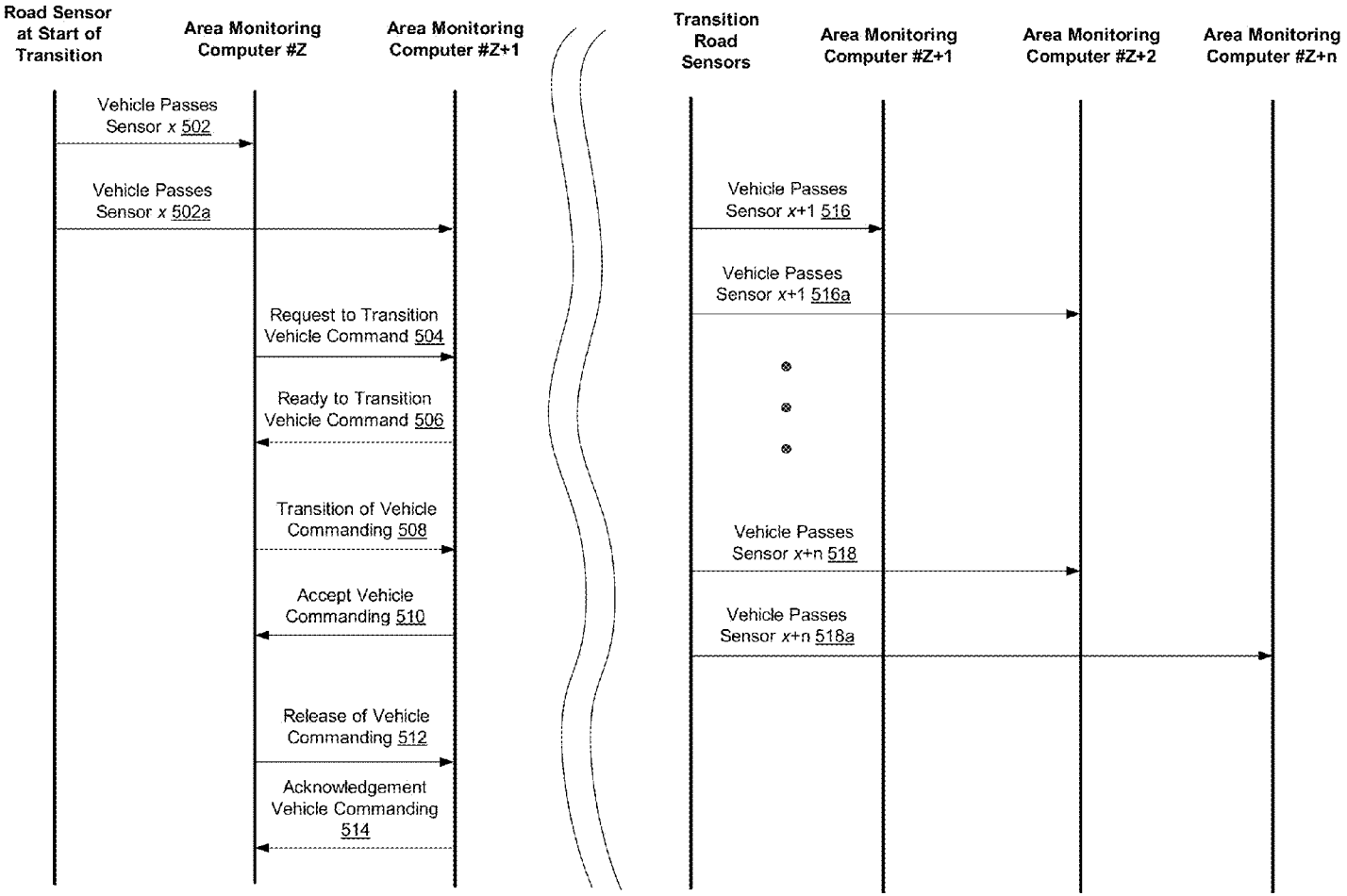
FIG. 5 is an illustration of an embodiment of a system thread for transitioning vehicles from one designated area of the system roadways to another designated area.

FIG. 5 is an illustration of an embodiment of a system thread for transitioning vehicles from one designated area of the system roadways to another designated area.

As noted above, according to some embodiments, the one or more area monitoring computers may be responsible for transitioning a vehicle from one local area monitoring computer to the next as the vehicle travels along the system roadways. For example, the roadway sensors may track the movement of each vehicle as it travels along the roadway. Additionally or alternatively, data received from each vehicle, e.g., global positioning data, may be utilized to track movement of each vehicle. According to still other embodiments, other sensors or devices may monitor and transmit data regarding vehicle locations along the roadways.

According to one embodiment, a pre-determined location may be designated between a first area monitoring computer responsible for a first designated area and a second area monitoring computer responsible for a second designated area along a vehicle route, e.g., a midpoint between a center of the first designated area and a center of the second designated area. According to some embodiments, the area within a predetermined range of the midpoint may be designated as a transition area. The transition area may be monitored by any suitable array of sensory devices assigned to the transition area.

For example, according to one embodiment, the transition area may be correlated to a section of roadway sensors within the transition area. For example, when a vehicle crosses a first roadway sensor (e.g., sensor x) within the transition area (e.g., operations 502 and 502*a*), or is otherwise determined to have entered the transition area, the first area monitoring computer (e.g., area monitoring computer Z) may send a series of request messages to the second area monitoring computer to initiate a hand-off of the vehicle (e.g., operations 504, 508, and 512). The second area monitoring computer (e.g., area monitoring computer Z+1) may respond with a number of acknowledgement messages for accepting the hand-off of the vehicle (e.g., operations 506, 510, and 514). That is, the first area monitoring computer may send a request to the second area monitoring computer to pass speed control of the vehicle as the vehicle approaches the second designated area. According to this embodiment, when the vehicle crosses a last roadway sensor within the transition area, the transition may be completed (e.g., operation 514). That is, the second area monitoring computer may take control of the vehicle and the first area monitoring computer may be free to take control of other vehicles transitioning into the first designated area.

According to further embodiments, as a particular vehicle travels along the system roadways, the particular vehicle may pass a number of sensors (e.g., sensors x+1 and x+n). Upon passing each sensor, a transition period may be established between adjacent local area monitoring computers (e.g., operations 516 and 516*a*, and operations 518 and 518*a*) such that a transition period is established between area monitoring computers along a route (e.g., area monitoring computers Z+1 and Z+2 associated with operations 516 and 516*a* and area monitoring computers Z+2 and Z+n associated with operations 518 and 518*a*). During the transition period, the area monitoring computers will conduct a number of request/response messages (e.g., operations 504 through 514 described above).

More specifically, with reference to the embodiment described above, roadway sensors may be placed at one second intervals along the roadway system to provide a continuous data stream of vehicle location and speed information for roadway system control of each vehicle. The system may be aware of precisely-calculated locations for each roadway sensor, as well as an established speed limit for each stretch of system roadway. With this known information, e.g., independently verified by each vehicle's GPS location, the system may calculate a precise location of each vehicle on the system roadways. The system may further be able to precisely accelerate and/or decelerate each vehicle to maintain the vehicle within its allocated actual time slot.

As should be appreciated, any consistent placement of roadway sensors, or any consistent data transmission from other sensors monitoring roadway conditions, vehicle data transmissions, etc., may be incorporated within the spirit of the present disclosure to provide one or more independent feedback loops to the system, e.g., regarding precise vehicle locations or other information.

Figure 6:
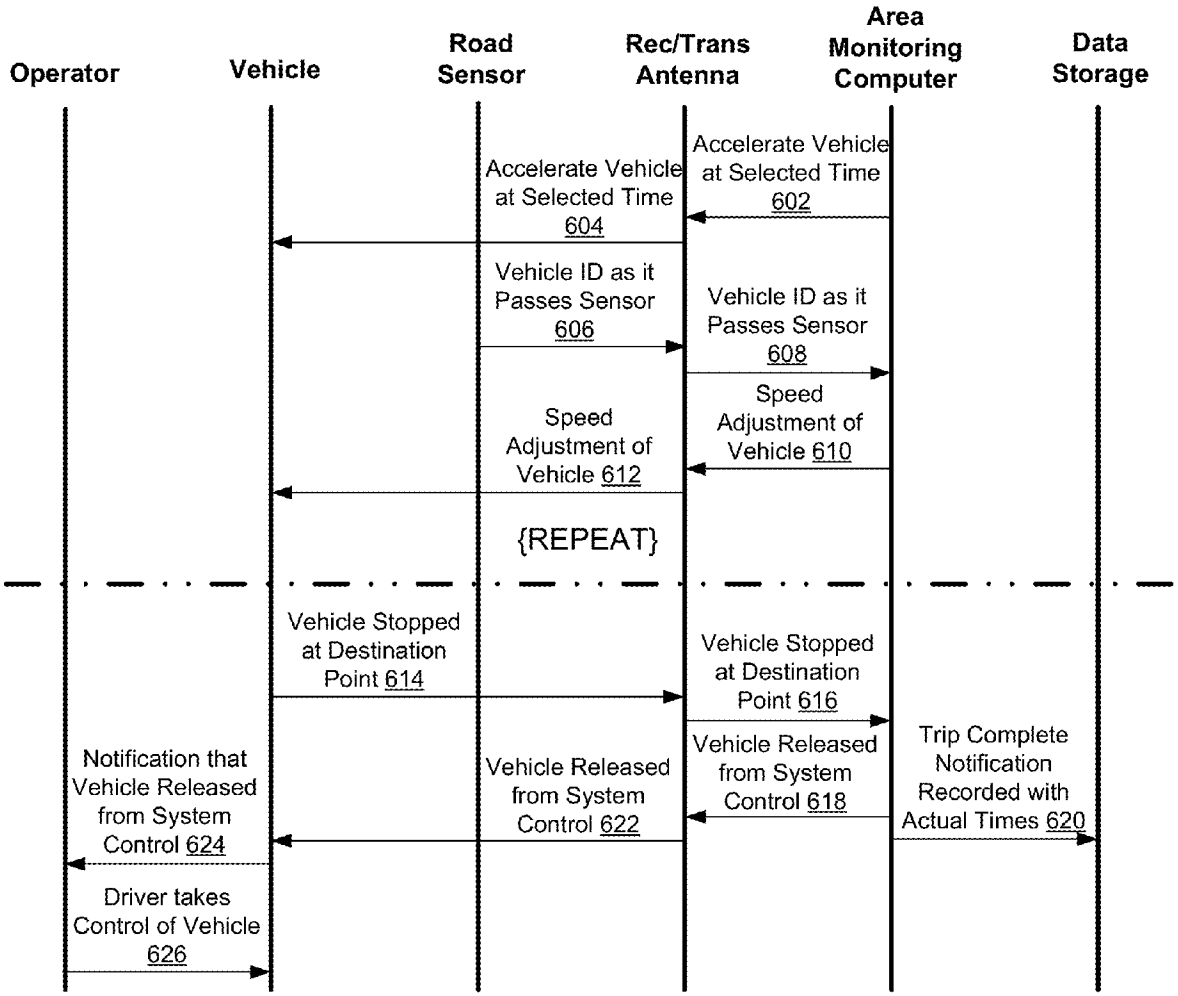
FIG. 6 is a diagram illustrating an embodiment of a system thread for messaging between various computers within the central-command computer system while a vehicle is traveling along system roadways.

FIG. 6 is a diagram illustrating an embodiment of a system thread for messaging between various computers within the central-command computer system while a vehicle is traveling along system roadways.

As described above with reference to FIG. 4, the specialized computer systems, vehicles, sensors, and other monitoring and data transmission devices may interact for purposes of communication and to provide data feedback loops within the integrated mass-transportation system. For example, as the embodiment of the messaging system thread illustrates, the operator, vehicle, sensors, antennas, area monitoring computers, etc., may initiate and/or receive any number of suitable requests or responses according to the disclosed system. Further, the various components and specialized computer systems may transmit and/or receive data as part of either a request or a response.

For example, at operation 602, a local area monitoring computer may initiate a request to accelerate a particular system vehicle at a selected time. For instance, this request may be received at a receiver/transmitter or other suitable transmission device (shown). Alternatively, the request may be received via a receiver resident on the particular system vehicle (not shown).

At operation 604, the request to accelerate may be transmitted by the receiver/transmitter to the particular system vehicle.

Thereafter, at operation 606, the accelerated vehicle may pass a sensor and the sensor may transmit the particular system vehicle's identification along with a time that the particular system vehicle passed the sensor. For instance, the transmitted vehicle identification and time may be received at a receiver/transmitter or other suitable transmission device (shown). Alternatively, the transmitted vehicle identification and time may be received via a receiver resident at the local area monitoring computer (not shown).

At operation 608, the particular system vehicle's identification and the time that the particular system vehicle passed the sensor may be transmitted by the receiver/transmitter to the local area monitoring computer.

According to some embodiments, at operation 610, the area monitoring computer may initiate a request to adjust the speed of the particular system vehicle based on receipt of the time that the particular system vehicle passed the sensor. For instance, this request to adjust speed may be received at a receiver/transmitter or other suitable transmission device (shown). Alternatively, the request to adjust speed may be received via a receiver resident on the particular system vehicle (not shown).

At operation 612, the request to adjust speed may be transmitted by the receiver/transmitter to the particular system vehicle.

According to embodiments, the particular system vehicle may come to a stop at a selected destination. According to further embodiments, at operation 614, the system vehicle may transmit a notification such that the system vehicle is stopped at the selected destination. For instance, the transmitted notification may be received at a receiver/transmitter or other suitable transmission device (shown). Alternatively, the transmitted notification may be received via a receiver resident at the local area monitoring computer (not shown).

At operation 616, the transmitted notification may be forwarded by the receiver/transmitter to the local area monitoring computer.

At operation 618, the local area monitoring computer may release the system vehicle from the system. For instance, the transmitted release may be received at a receiver/transmitter or other suitable transmission device (shown). Alternatively, the transmitted release may be received via a receiver resident at the system vehicle (not shown).

Further, at operation 620, the local area monitoring computer may transmit a trip complete notification with a time of completion to a data storage location.

At operation 622, the transmitted release may be transmitted by the receiver/transmitter to the system vehicle.

At operation 624, the system vehicle may notify the operator that the system vehicle has been released from the system.

At operation 626, the operator may take control of the system vehicle.

As may be appreciated, description of messaging system thread 600 is provided for purposes of explanation and example only. Indeed, although the method is described as a series of steps, each step should not be understood as a necessary step, as additional and/or alternative steps may be performed within the spirit of the present disclosure. Additionally, described steps may be performed in any suitable order and the order in which steps were described is not intended to limit the method in any way.

Traffic Flow Management Embodiments

Figure 7:
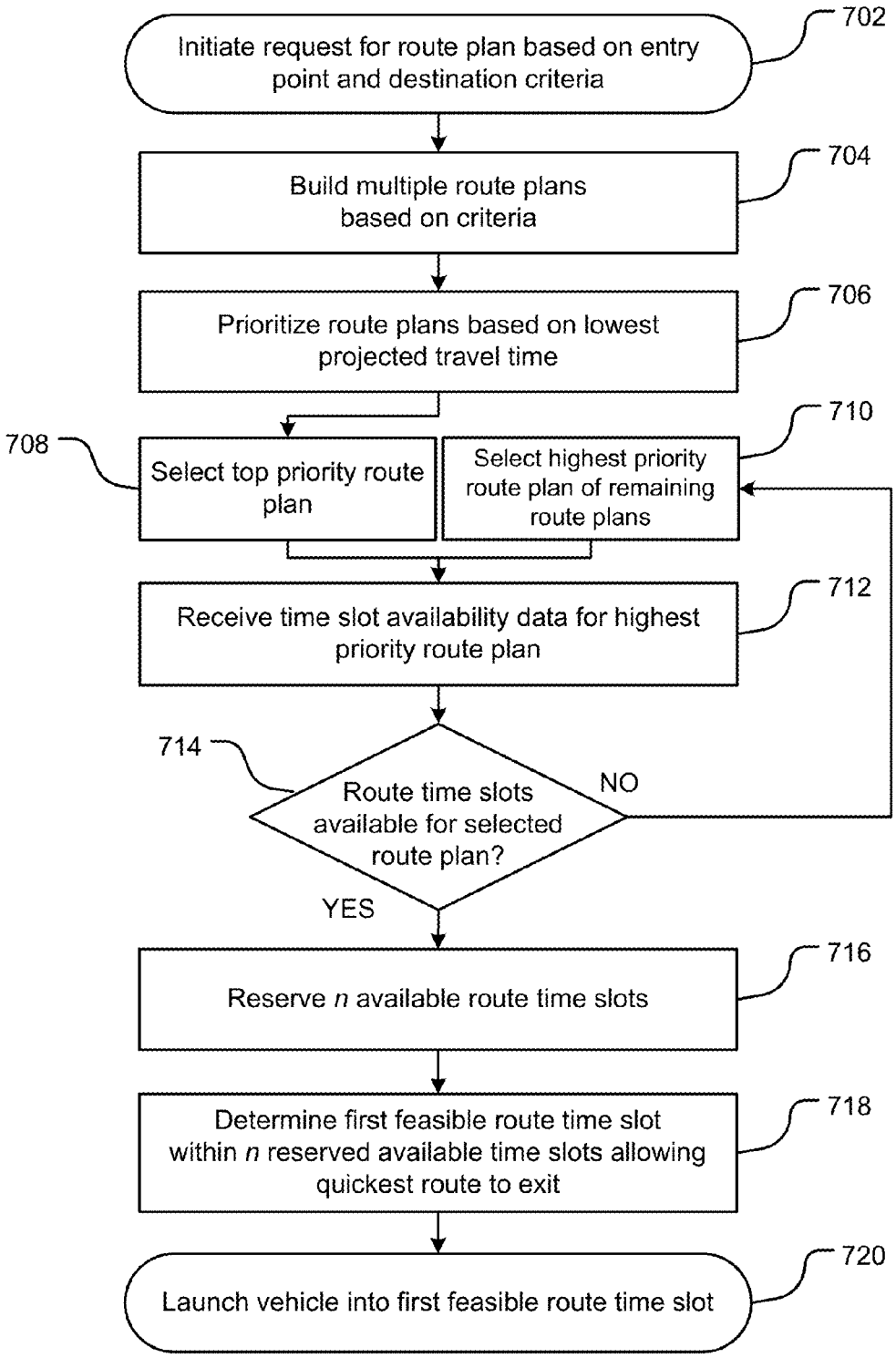
FIG. 7 is a flow diagram illustrating an embodiment of a method for building an optimal route plan for a system vehicle based on an entry station and a selected destination.

FIG. 7 is a flow diagram illustrating an embodiment of a method for building an optimal route plan for a system vehicle based on an entry station and a selected destination.

At operation 702, a route plan may be requested for a particular system vehicle. For example, as discussed above with reference to the guidance of system vehicles, in embodiments, when an operator enters a system roadway at an entry station, the operator may be required to relinquish control over guidance of the system vehicle to a module or subsystem of the central-command computer system. Additionally, the operator may select and input a destination at the entry station, for example.

At operation 704, multiple route plans may be generated based on the access point and the selected destination. For instance, either on-board or central-command computers may map a best route to the selected destination based on real-time system roadway loading. When a particular system roadway is in heavy use, system computers may select an alternative path for a vehicle provided that it reaches the exit point as directly and efficiently as possible. Additionally, a system-selected route may appear on a vehicle mapping screen and the operator may be able to visualize a projected travel time until the vehicle should reach selected destination. As will be appreciated, utilizing the central-command computers to determine a best path for each individual vehicle traveling on the system roadways allows for optimal system performance and efficiency because traffic load balancing may be utilized across multiple available routes.

At operation 706, the multiple route plans may be prioritized based on a lowest projected travel time, for example. Specifically, the central-command computers may in embodiments determine an optimal route for each vehicle, including when it should enter the system roadway and when and where it should exit the system. One or more central-command computers may also determine a projected travel time and specific distance for each system vehicle to its selected destination.

At operation 708, a top priority route plan may be selected. Specifically, according to embodiments as described previously, in the process of building an appropriate route plan, a segment routing computer may determine multiple potential route plans to a selected destination, e.g., three route plans. A segment routing computer may also determine a highest, or top, priority route plan of the multiple potential route plans, the top priority route plan having the lowest projected travel time to the selected destination during optimal travel conditions. Further, it may be determined whether the projected travel times for the alternative route plans, e.g., the other two route plans, are within 25 percent of the lowest projected travel time of the top priority route plan. That is, if the alternative route plans are within 25 percent of the lowest projected travel time, they may be considered feasible alternative route plans. If the alternative route plans are not within 25 percent of the lowest projected travel time, they may be rejected as non-feasible alternative route plans. In some cases, there may only be one viable route plan, i.e., the top priority route plan.

At operation 712, time slot availability data may be received for the top priority route plan (or, the highest priority alternative route plan). For instance, time slot availability data for each roadway (i.e., current availability data) along the top priority route plan may be received from a segment scheduling computer and/or the master scheduling computer.

At determination operation 714, route time slot availability may be determined along the top priority route plan. Specifically, available route time slots refer to time slots not already occupied (i.e., currently available) or projected to be occupied by other vehicles (e.g., as a result of merging vehicles from other roadways along the route). Similarly, available actual time slots refer to time slots not currently occupied by vehicles. Thus, a certain number, n, of available route time slots projected to pass the entry station may be reduced if there are merger points that the vehicle must negotiate along the route. Thus, although there may be multiple available route time slots to a vehicle at an entry point, many of the available route time slots may be eliminated en route at merger points where other vehicles are projected to occupy the actual time slots corresponding to those available route time slots.

At operation 710, for instance when time slots are not available for the top priority route plan, feasible alternative route plans of the multiple generated route plans may be prioritized and evaluated for available route time slots. According to embodiments, upon selecting a highest priority feasible alternative route plan, the methods may proceed to operation 712. Alternatively, if no feasible alternative route plans are available, the top priority route plan may be reevaluated for available time slots after a predetermined wait period (e.g., after a wait period of 1 minute, 5 minutes, 10 minutes, etc.) at determination operation 714. According to further embodiments, when time slots are still not available for the top priority route plan after the predetermined wait period, alternative route plans may be reevaluated to determine whether the alternative route plans are within 25 percent of the lowest projected travel time of the top priority route plan. If at least one of the alternative route plans is within 25 percent of the lowest projected travel time after the predetermined wait period, the at least one alternative route plan may be designated a feasible alternative route plan and may be evaluated for available route time slots at determination operation 714.

At operation 716, upon determining available route time slots for at least one of the multiple route plans, n available route time slots may be reserved on the at least one route plan. According to at least some embodiments, once a segment routing computer establishes that the top priority route plan has time-slot availability, a segment scheduling computer may reserve a certain number, n, of next available route time slots, e.g., the next 30 available route time slots corresponding to a next 30 available actual time slots projected to pass the entry station along an adjacent roadway. However, the next 30 available route time slots may correspond to a different set of actual time slots if the route plan requires a merge from the adjacent roadway onto one or more different roadways. Temporarily reserving the next n available route time slots may prevent other segment scheduling computers from allocating available actual time slots along the top priority route while the local segment scheduling computer evaluates and confirms an optimal route plan.

According to some embodiments, upon reserving available route time slots from the master scheduling computer, the local segment scheduling computer may then assign the requesting vehicle, e.g., via the vehicle's unique identification number, to the reserved set of available route time slots for a top priority route plan. As described above, when there are no available route time slots for the top priority route plan, the segment scheduling computer may conduct the same evaluation for the next priority route plan, and so on. When an optimal route plan is determined, that is, a route plan having a lowest estimated travel time and an optimal route time slot, the segment scheduling computer may schedule the optimal route plan with the master scheduling computer to reserve one or more actual time slots corresponding to the optimal route time slot on the system.

At operation 718, the local segment scheduling computer may further determine a first feasible route time slot (FFRTS) among the next n available route time slots. The FFRTS may be a first available route time slot that is available throughout the entire route and also provides the lowest travel time to the selected destination. Calculating a projected travel time to an ultimate destination, rather than to a particular exit point, may enable FFRTSs from different route plans to be more easily compared. In embodiments, the local segment scheduling computer may determine the FFRTS using a number of parameters such as current weather conditions, traffic conditions, projected traffic load, and selected destination. For example, according to some embodiments, the FFRTS may be determined based on merging points along the route, etc. Thus, according to this embodiment, the local segment scheduling computer may communicate with one or more roadway sensors, other segment scheduling and area monitoring computers, the master scheduling computer, etc., to gather real-time data associated with the parameters. According to other embodiments, one or more other specialized computer systems may collect data regarding the parameters and may determine a FFRTS and transmit such information to an appropriate area monitoring computer for launching the vehicle into an actual time slot corresponding to the FFRTS.

According to some embodiments, when alternate route plans are available, the same calculation may be made for the alternate options and then a projected travel time for the FFRTS on the top priority route may be compared to the projected travel times for a FFRTS on each alternate route. The local segment scheduling computer may then select the specific route having the shortest projected travel time in a FFRTS, rendering it an optimal route time slot on an optimal route plan. In some embodiments, there may not be any feasible route time slots within the reserved n available route time slots. Regardless of the number of routes examined, the local segment scheduling computer may request a next n number of available route time slots from the master scheduling computer, for instance, the next 30 available route time slots. This process may continue until a FFRTS on an evaluated route plan is determined and the vehicle is launched onto the system roadway.

Upon confirming existence of a FFRTS, the optimal route plan may be downloaded to the requesting vehicle with information regarding one or more actual time slots corresponding to the FFRTS, directions regarding any decision points along the optimal route, and the precise times when each unique actual time slot will be in position along the optimal route. The optimal route plan may also be downloaded to one or more appropriate area monitoring computers along the optimal route.

At operation 720, the particular system vehicle may be launched into the FFRTS. It should be understood that use of actual and route time slots is one way that features of some embodiments may be implemented. As will be described further herein, each actual time slot is unique and may have a precisely calculated time that it will be at each decision point along a route. Thus, unique actual time slots may be synchronized for a complete integration and smooth transition of multiple vehicles along the entire system roadway. Once an optimal route time slot is determined for an optimal route plan, an exact time for launching the vehicle into an actual time slot corresponding to the optimal route time slot may be calculated based on the established speed limit on the roadway adjacent to the entry point. That is, according to some embodiments, based on an actual time slot flow as defined by the time slot engine, the precise time that the actual time slot corresponding to an optimal route time slot will pass the entry point on an adjacent roadway may be calculated. For example, an estimated travel time on system roadways may be calculated from the beginning to the end of the optimal route plan including a single merge from a first roadway to a second roadway. That is, estimated travel time on system roadways may be calculated by subtracting a calculated time a first actual time slot corresponding to the optimal route time slot will pass the entry station on the first roadway from a calculated time a second actual time slot corresponding to the optimal time slot is projected to reach an exit point on the second roadway, e.g., based on speed limits established for the first and second roadways along the optimal route.

Additionally, according to some embodiments, each unique actual time slot may further be separated from other actual time slots by a buffer zone into which no vehicles may be launched. Buffers may not only prevent collisions between vehicles on the system roadways, but may also provide for synchrony when merging vehicles from one roadway to another. That is, by providing a buffer about each actual time slot, a vehicle traveling within the actual time slot may be able to travel within a range of speeds about the speed limit established for a roadway. This feature may allow a vehicle to accelerate into or decelerate out of an actual time slot without falling outside of the buffer zone. Additionally or alternatively, when it is detected that a vehicle is falling outside of the range of speeds around the established speed limit, such that the vehicle may fall outside of the buffer zone, the system may attempt to accelerate or decelerate the vehicle. If it appears that for technical, mechanical, or other reasons, the vehicle cannot be maintained within its designated actual time slot, the system may exit the vehicle from the roadway. While this may be inconvenient for a particular operator, the safety of that operator and others on the roadway is paramount. Additionally, after diagnostic testing is conducted and any issues with the vehicle are resolved, a new route plan may be determined, and the vehicle may be safely launched back onto the system. In some embodiments, the buffers are merely other adjacent time slots that are maintained unoccupied.

As described above, a local area monitoring computer, i.e., the area monitoring computer responsible for the area adjacent to the entry station, may in embodiments take control of the requesting vehicle and may launch it into an actual time slot corresponding to the optimal route time slot by accelerating the requesting vehicle based on the precise time the actual time slot will pass the entry point. Thereafter, the remaining route time slots of the reserved set of available route time slots may be released back to the master scheduling computer. Additionally, the requesting vehicle may communicate with one or more area monitoring computers along the suitable route and may provide them with information validating a planned location of the requesting vehicle as it travels along the roadway system. Upon reaching the designated exit station, an appropriate area monitoring computer may exit the vehicle from the system, as described above.

As may be appreciated, description of the method 700 for building an optimal route plan is provided for purposes of explanation and example only. Indeed, although the method is described as a series of steps, each step should not be understood as a necessary step, as additional and/or alternative steps may be performed within the spirit of the present disclosure. Additionally, described steps may be performed in any suitable order and the order in which steps were described is not intended to limit the method in any way.

Figures 8A, 8B:
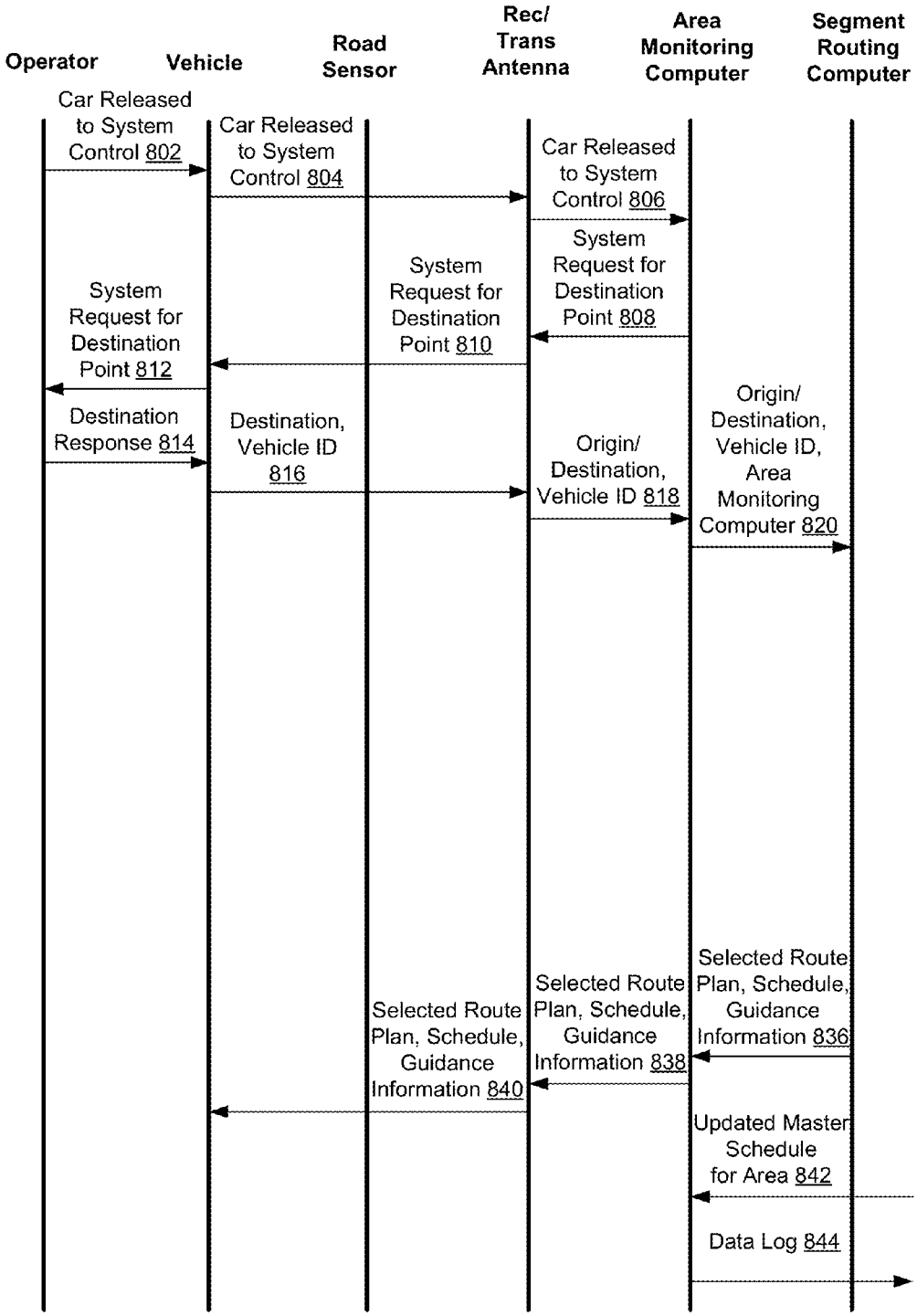
FIGS. 8A and 8B are diagrams illustrating an embodiment of a system thread 800 for building one or more route plans.
Figures 8A, 8B:
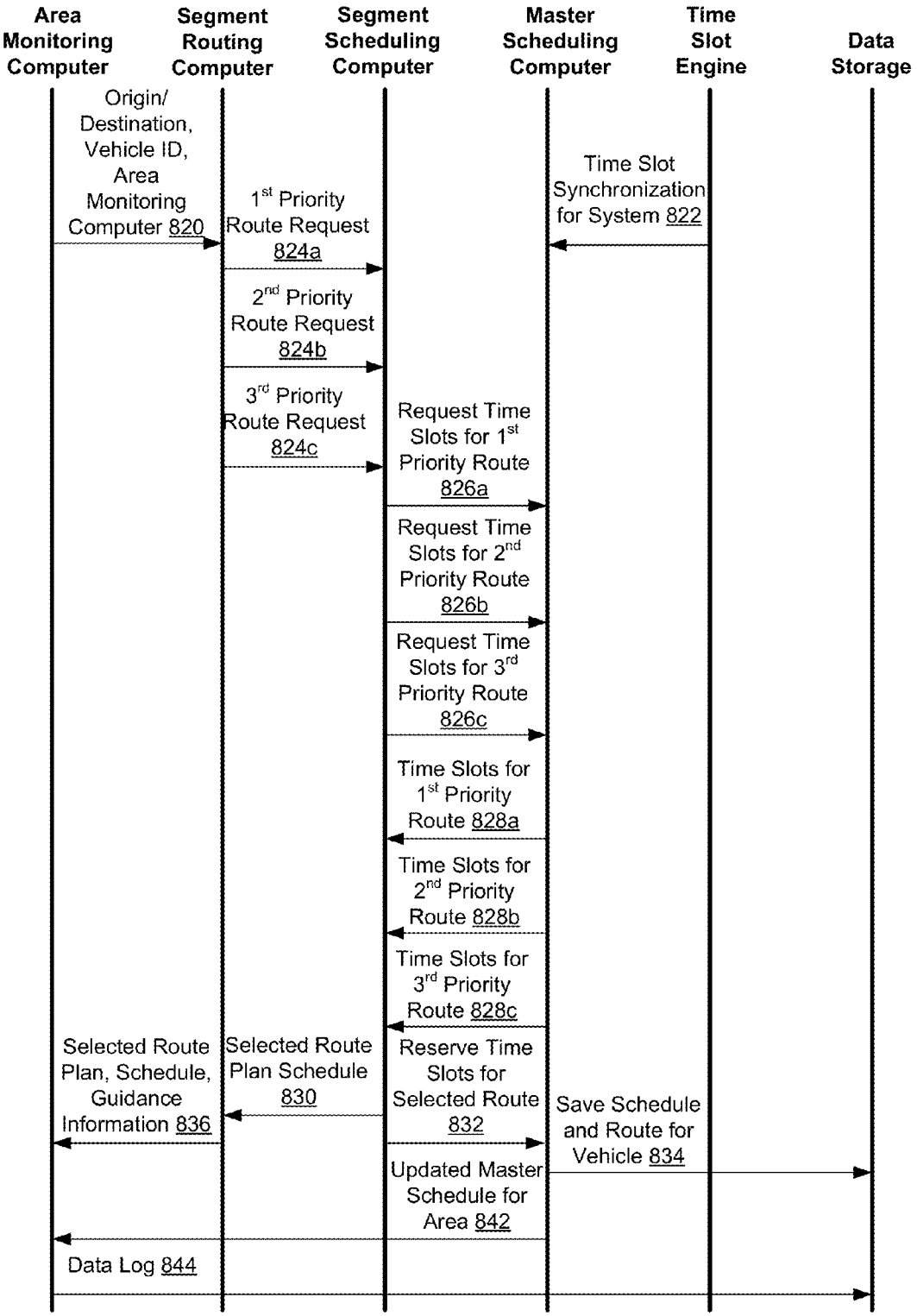

FIGS. 8A and 8B are diagrams illustrating an embodiment of a system thread for building one or more route plans. FIGS. 8A and 8B illustrate a continuous system thread, overlapping with respect to messages sent and received by an area monitoring computer and a segment routing computer.

According to some embodiments, the building of a route plan may occur as a series of request/response message threads (e.g., request/response messages 802 through 812).

Specifically, at operation 802, when a system vehicle arrives at an entry station, the operator may release control of the vehicle. Further, upon release of the system vehicle, at operation 804, a request indicating operator release may be transmitted from the system vehicle.

At operation 806, the request indicating operator release may be transmitted via a receiver/transmitter, for example, to a local area monitoring computer.

At operation 808, the local area monitoring computer may initiate a request for the system vehicle's destination point. At operation 810, the receiver/transmitter may forward the request for the destination point to the system vehicle. At operation 812, the system vehicle may forward the request for the destination point to the operator.

At operation 814, the operator may input the destination point. Thereafter, the system vehicle may forward the requested destination point and a vehicle identification (via operation 816) to a receiver/transmitter, which may forward the requested destination point and the vehicle identification (via operation 818) to the local area monitoring computer.

At operation 820, the local area monitoring computer may request a plurality of route plans for the system vehicle from the entry point to the requested destination point from a local segment routing computer. That is, the system vehicle's on-board computer may send a request to a segment routing computer for a route plan from Point A (e.g., entry station) to Point B (e.g., selected destination). The requested route plan may extend through one or more areas of the system roadway and one or more area monitoring computers may be responsible for each designated area.

At operation 822, a time slot engine may transmit a time-slot synchronization for the system to a master scheduling computer.

At operations 824*a*, 824*b*, and 824*c*, the local segment routing computer may send the plurality of route plans to a local segment scheduling computer.

Thereafter, at operations 826*a*, 826*b*, and 826*c*, the local segment scheduling computer may request time slot availability for the plurality of route plans from the master scheduling computer.

At operations 828*a*, 828*b*, and 828*c*, the master scheduling computer may respond to the local segment scheduling computer with the time slot availability for the plurality of route plans.

Upon evaluating the time slot availability for the plurality of route plans, the local segment scheduling computer may transmit a selected route plan to the local segment routing computer (via operation 830) and transmit a request to reserve time slots for the selected route plan from the master scheduling computer (via operation 832).

At operation 834, the master scheduling computer may transmit a request to save the selected route plan for the system vehicle to a data storage location.

The local segment routing computer may transmit the scheduling and guidance information for the selected route plan to the local area monitoring computer (via operation 836). The local area monitoring computer may transmit the scheduling and guidance information for the selected route plan to the system vehicle via the receiver/transmitter (e.g., via operations 838 and 840).

At operation 842, the master scheduling computer may transmit a request to update the master schedule to the local area monitoring computer.

At operation 844, the local area monitoring computer may transmit log data to the data storage location.

As may be appreciated, description of the method 800 for building one or more route plans is provided for purposes of explanation and example only. Indeed, although the method is described as a series of steps, each step should not be understood as a necessary step, as additional and/or alternative steps may be performed within the spirit of the present disclosure.

Additionally, described steps may be performed in any suitable order and the order in which steps were described is not intended to limit the method in any way.

Figure 9A:
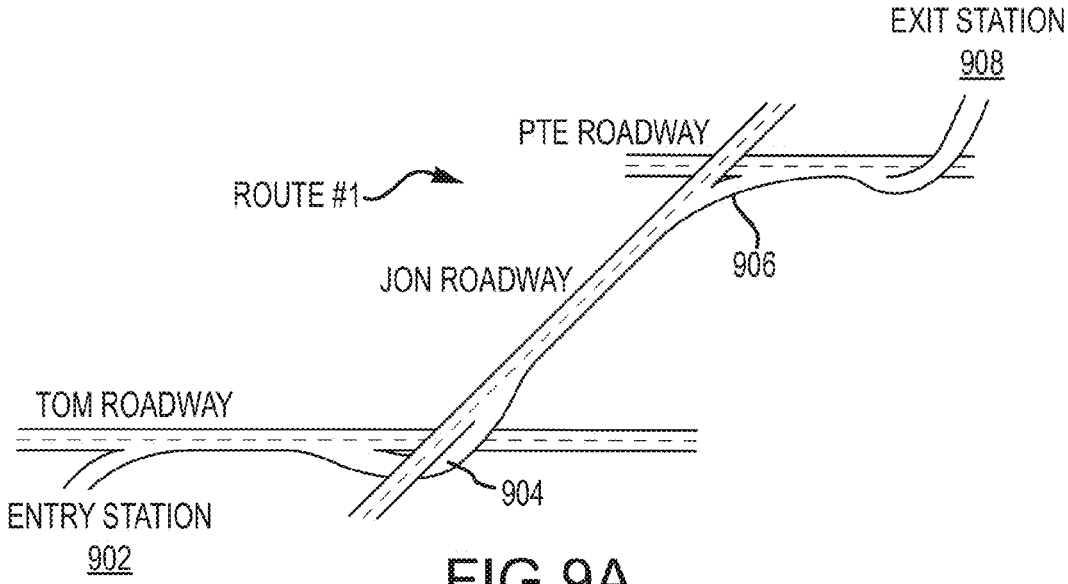
FIGS. 9A and 9B illustrate embodiments of two example route plans from an entry station to an exit station. Specifically.
Figure 9B:
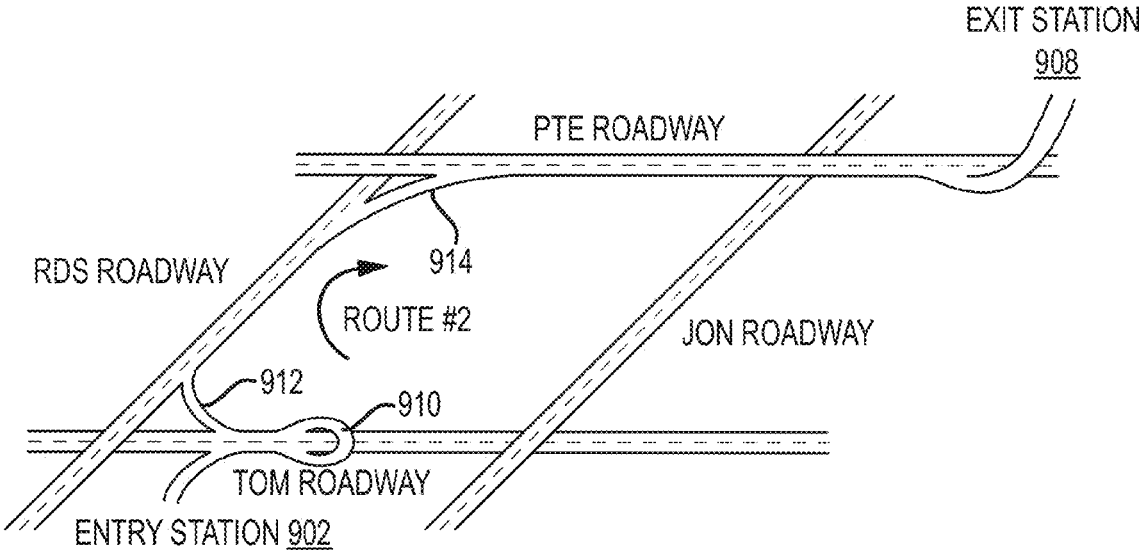

Illustration of First Feasible Route Time Slot Determination According to an Embodiment FIGS. 9A and 9B illustrate embodiments of two example route plans from an entry station to an exit station. Specifically, FIG. 9A illustrates a first route plan and FIG. 9B illustrates a second route plan.

According to embodiments described herein, one or more route plans may be generated for a vehicle from an entry station to a selected destination. As illustrated in FIG. 9A, a first route plan, i.e., Route #1, provides for entering the roadway at an entry station 902 adjacent to a TOM Roadway and then merging onto a JON Roadway via ramp 904. Thereafter, the first route plan provides for merging onto a PTE Roadway via ramp 906 and then exiting the PTE Roadway at an exit station 908 that is convenient to the selected destination.

Alternatively, as illustrated in FIG. 9B, a second route plan, i.e., Route #2, provides for entering the TOM Roadway at the same entry station 902 as the first route plan. However, the second route plan provides a loop-back 910 and then a merge onto the TOM Roadway in an opposite direction from the first route plan. Thereafter, the second route plan provides for merging onto an RDS Roadway via ramp 912 and then for merging onto the PTE Roadway via ramp 914. As with the first route plan, the second route plan provides for exiting the PTE Roadway at the exit station 908 that is convenient to the selected destination.

As may be appreciated, the second route plan may entail a greater travel distance on system roadways. However, based on time slot availability, it is possible that the second route plan may provide the lowest projected travel time. That is, if fewer or no actual time slots are available along the roadways planned for the first route, the second route plan may result in a more optimal route plan.

However, as illustrated, the second route plan involves four merge events, i.e., a merge onto the TOM Roadway from the entry station 902, a merge onto the TOM Roadway in the opposite direction from the loop-back 910, a merge onto the RDS Roadway via ramp 912, and a merge onto the PTE Roadway via ramp 914. Alternatively, the first route plan only involves three merge events, i.e., a merge onto the TOM Roadway from the entry station 902, a merge onto the JON Roadway via ramp 904, and a merge onto the PTE Roadway via ramp 906. As described above, each merge event may involve the elimination of additional available route time slots. As such, each additional merge event may statistically correspond to an increase in projected travel time. Note that this increased projected travel time may be in addition to a greater travel distance planned for the second route. However, according to some embodiments, a route plan having additional merge events and travel distance may still be favored if that route plan has a lower projected travel time over other routes that are shorter and more direct, but also more congested.

According to an example embodiment, for purposes of the following figures, the first route plan, illustrated in FIG. 9A, i.e., Route #1, may correspond to a top priority route plan.

Figure 10:
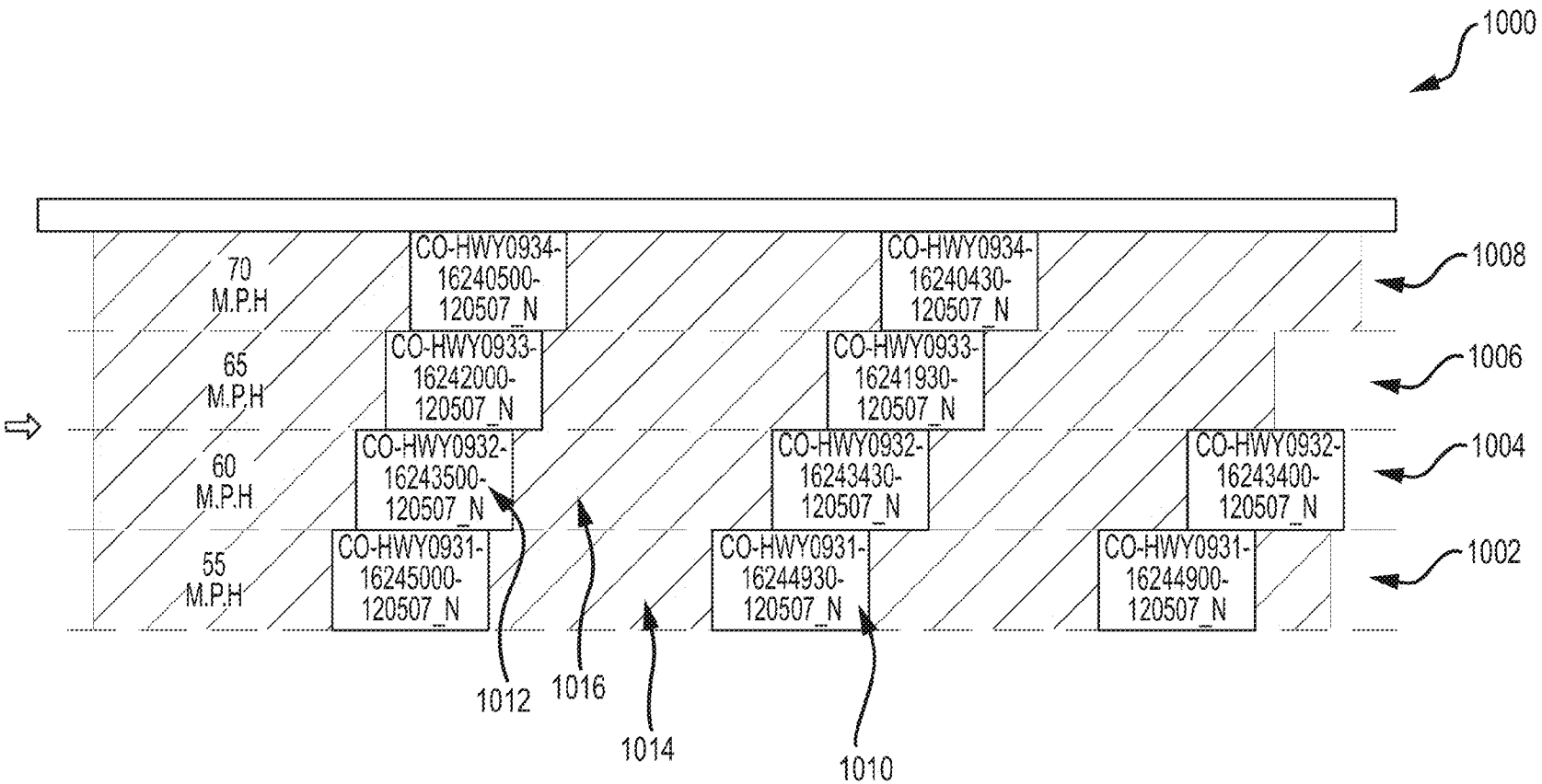
FIG. 10 is a diagram of an embodiment illustrating actual time slots associated with a multiple-lane system roadway.

FIG. 10 is a diagram of an embodiment illustrating actual time slots associated with a multiple-lane system roadway.

According to embodiments, system roadways may include multiple lanes, as described above. That is, heavy traffic congestion in some metropolitan areas may necessitate use of parallel lanes in some embodiments to increase the number of vehicles able to travel on system roadways. The central-command computers may determine a most appropriate lane for a particular vehicle at any one time, may maneuver the vehicle into the most appropriate lane, and may later maneuver the vehicle into another appropriate lane depending on a location of a selected exit station, roadway conditions, the needs of other vehicles, etc.

According to further embodiments, in order to facilitate movement of vehicles between parallel lanes, the system vehicles in different parallel lanes may travel at different speeds, e.g., inside lanes may move faster than outer lanes. For instance, in a double-lane example, the inside lane may travel five miles-per-hour (mph) faster than the outside lane. According to embodiments, this difference in speed may provide for actual time slots within the inside and outside lanes to pass one another. As such, this may facilitate transitioning from an actual time slot in one lane to an actual time slot in the other lane. According to embodiments, the central-command computers may move vehicles from one lane to another as quickly as possible to allow the greatest number of options as possible in transitioning system vehicles on and off system roadways.

An embodiment of a four-lane example is illustrated in FIG. 10. As illustrated, roadway 1000 comprises a first lane 1002, a second lane 1004, a third lane 1006, and a fourth lane 1008. According to the illustrated embodiment, traffic in the first lane 1002 travels at 55 mph, traffic in the second lane 1004 travels at 60 mph, traffic in the third lane 1006 travels at 65 mph, and traffic in the fourth lane 1008 travels at 70 mph.

Further, according to the illustrated embodiment, first actual time slot 1010 is provided in the first lane 1002 and second actual time slot 1012 is provided in the second lane 1004.

Actual time slots 1010 and 1012 may be identified according to a naming scheme outlined in the following identification table (Table I).

TABLE I

| Time Slot Identification SS-HWY###A-HHMMSSTT-DDCCYY_a | |
|---|---|
| SS | State |
| HWY | ### - Highway Number |
| A | Lane Number |
| HHMMSSTT | HH - Hour (24 Hour Clock) |
| | MM - Minute |
| | SS - Second |
| | TT - Tenth of Second |
| DDCCYY | DD - Day |
| | CC - Month |
| | YY - Year |
| a | Direction of Traffic |

The table illustrates an embodiment for uniquely identifying actual time slots within the disclosed system. It should be appreciated that within the spirit of the present disclosure any number of suitable identification systems are possible.

For example, according to Table I, a time slot identifier that may include a first field comprising a state designation, a second field comprising a highway designation (e.g., a combination of letters or numbers), a third field comprising a lane designation (e.g., comprising consecutive numbers or letters), a fourth field comprising a time designation (e.g., in tenths of a second, seconds, minutes, and hours on a 24-hour clock), a fifth field comprising a date designation (e.g., day DD, month CC, year YY), and a sixth field comprising a directional designation (e.g., N, S, E, W).

Thus, the illustrated embodiment discloses that the first actual time slot 1010 may be designated by the state of "Colorado," Highway "093," and lane "1." According to the illustrated embodiment, the first actual time slot 1010 was created at time 1600 hours, 24 minutes, 49 seconds, and 30 tenths of a second on May 12, 2007. The first actual time slot 1010 travels north. Alternatively, the second actual time slot 1012 may be designated by the state of "Colorado," Highway "093," and lane "2." The second actual time slot 1012 was created at time 1600 hours, 24 minutes, 35 seconds, and 0 tenths of a second on May 12, 2007. The second actual time slot 1012 also travels north.

As may be appreciated by the illustrated embodiment, as the first actual time slot 1010 is traveling at 5 mph less than the second actual time slot 1012. Thus, depending on the lengths of buffer zones 1014 and 1016, the second actual time slot 1012 will coincide with the first actual time slot 1010 after a period of time. As may be further appreciated, when the second actual time slot 1012 and the first actual time slot 1010 coincide, a vehicle may be transferred from one actual time slot to the other.

Figure 11A:
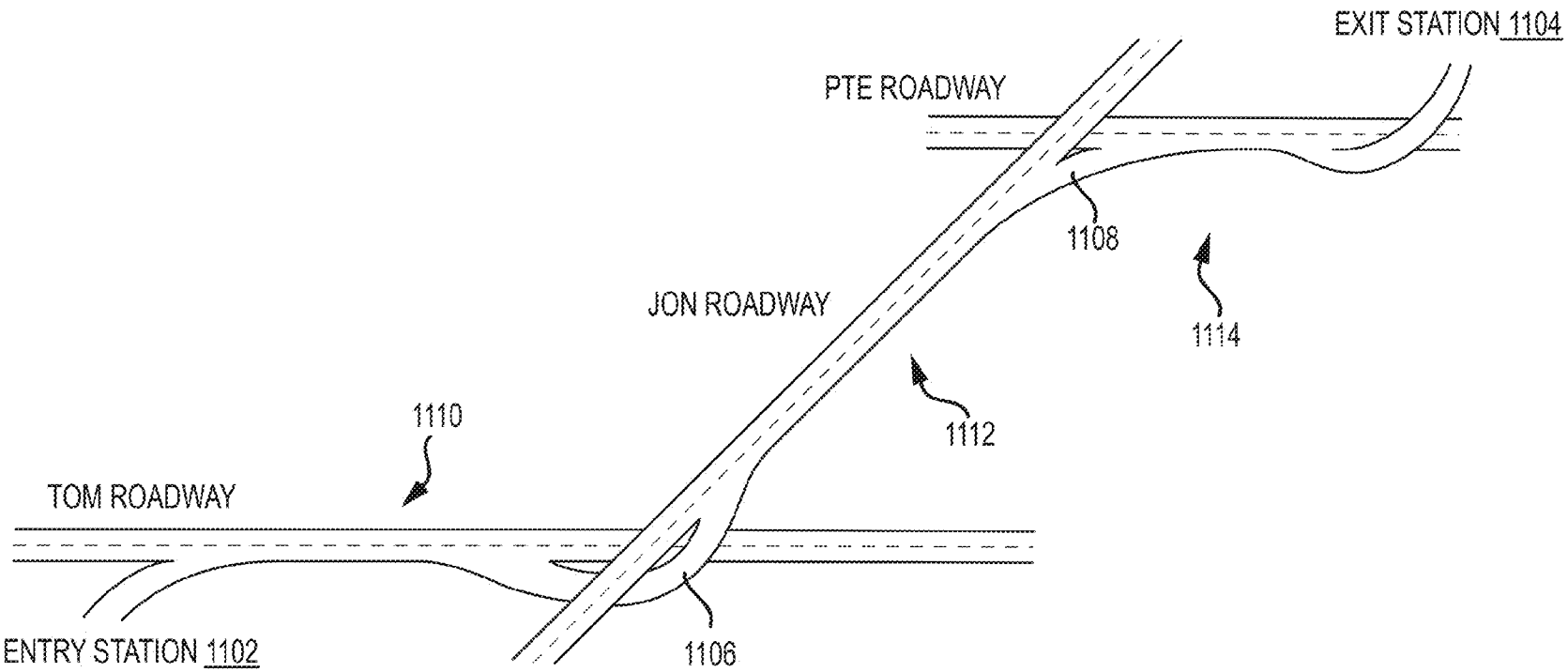
FIG. 11A illustrates an embodiment of a top priority route plan from an entry station to an exit station.
Figure 11B:
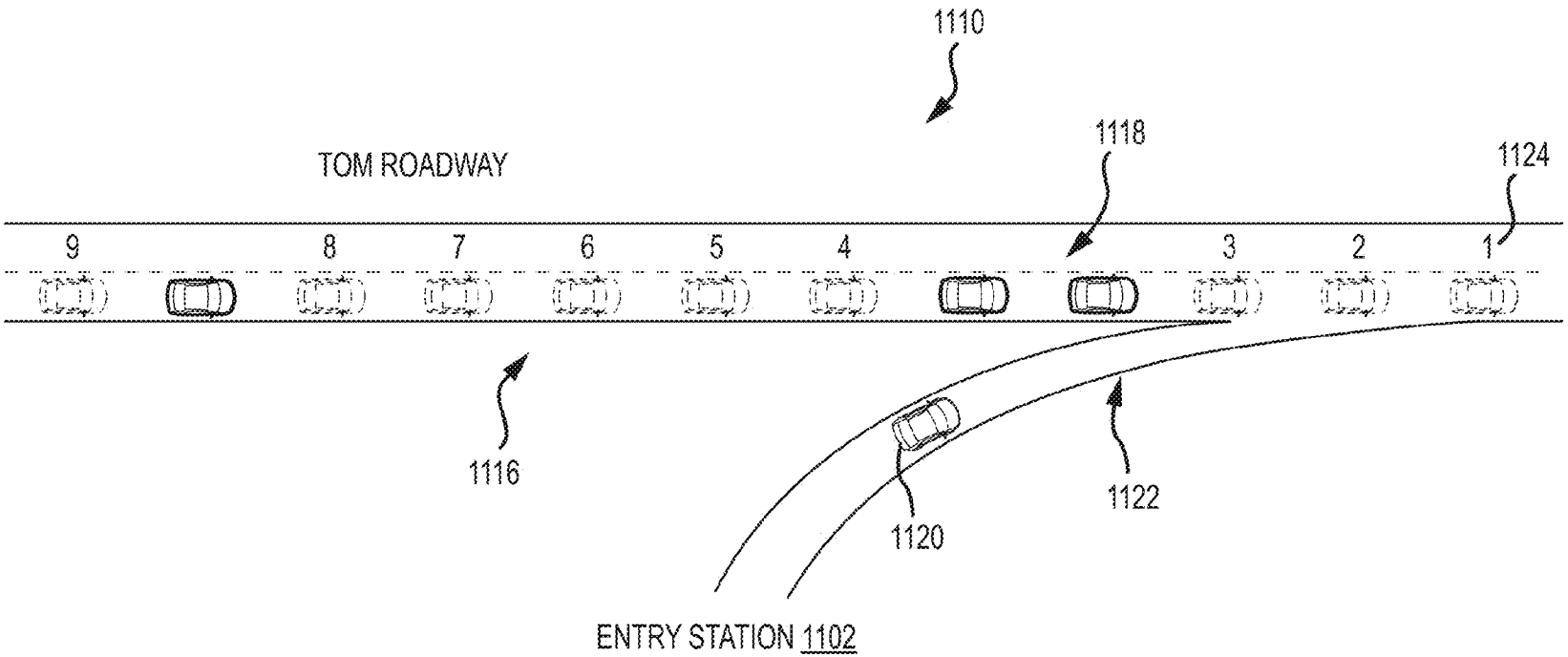
FIG. 11B illustrates an embodiment of a first nine available route time slots along a first segment of the top priority route plan illustrated in FIG. 11A.
Figure 11C:
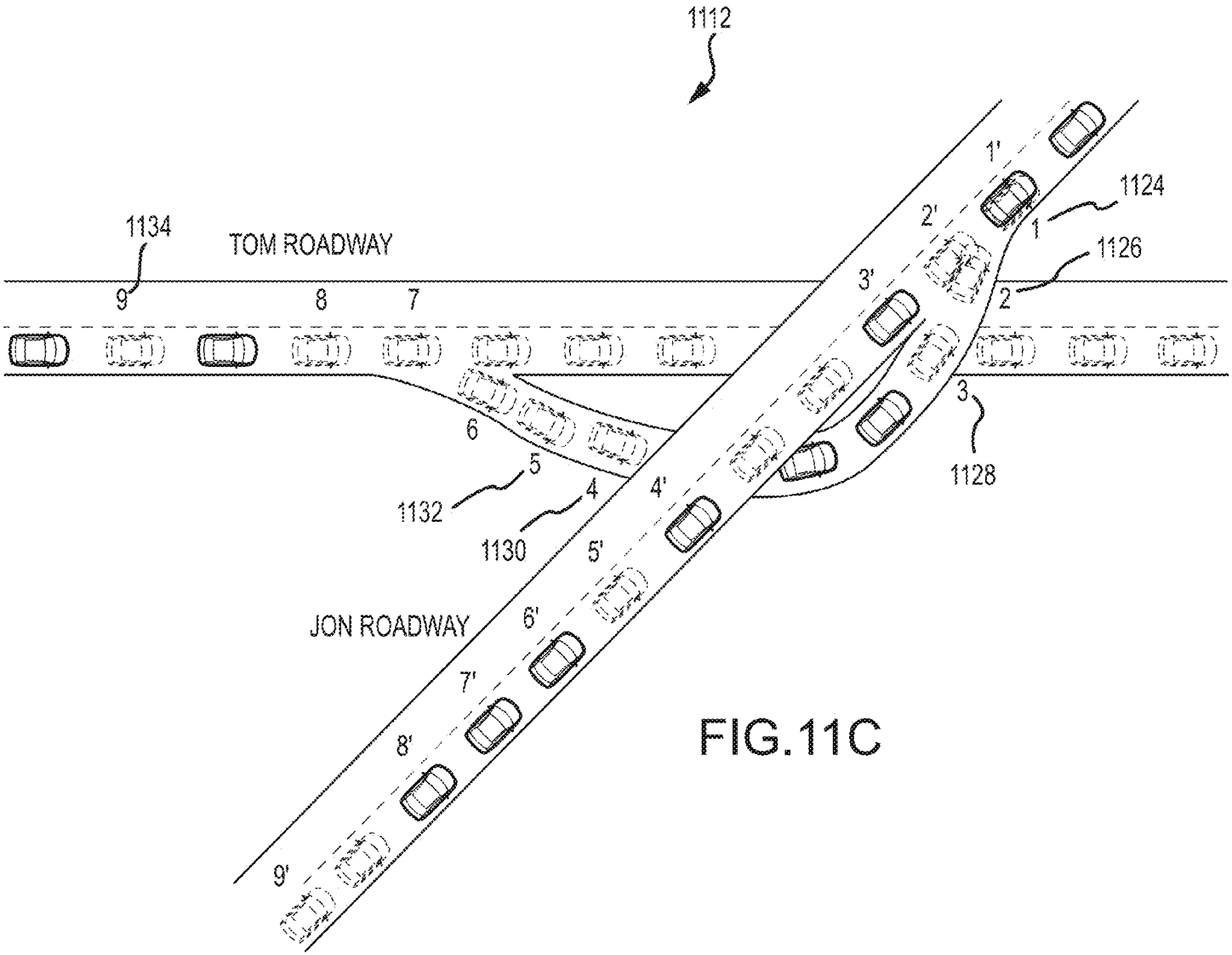
FIG. 11C illustrates an embodiment of a first merge of the first nine available route time slots from a first highway to a second highway along the top priority route plan illustrated in FIG. 11A.
Figure 11D:
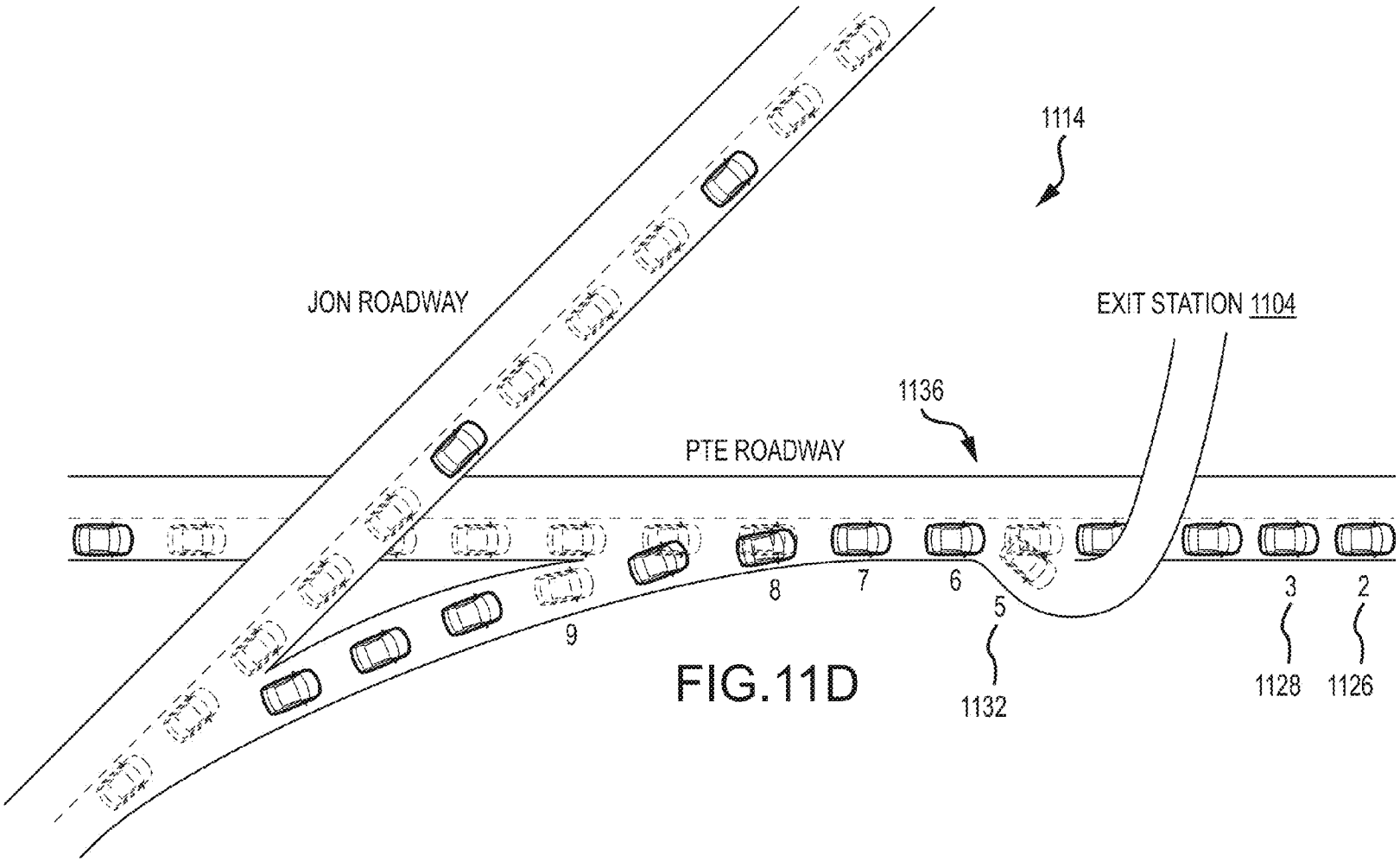
FIG. 11D illustrates an embodiment of a second merge of the first nine available route time slots from the second highway to a third highway along the top priority route plan illustrated in FIG. 11A.

FIGS. 11A-11D illustrate an embodiment for determining a FFRTS, as described above with reference to FIG. 7. Specifically, FIG. 11A illustrates an embodiment of a top priority route plan from an entry station to an exit station. FIG. 11B illustrates an embodiment of a first nine available route time slots along a first segment of the top priority route plan illustrated in FIG. 11A. FIG. 11C illustrates an embodiment of a first merge of the first nine available route time slots from a first highway to a second highway along the top priority route plan illustrated in FIG. 11A. FIG. 11D illustrates an embodiment of a second merge of the first nine available routes from the second highway to a third highway along the top priority route plan illustrated in FIG. 11A.

As noted above, FIG. 11A illustrates an embodiment of a top priority route plan from an entry station 1102 to an exit station 1104.

As described in detail above, a top priority route plan may be built and isolated by a local segment routing computer based on a lowest estimated travel time to the destination. According to the illustrated top priority route plan, the entry station 1102 is shown adjacent to a first roadway, i.e., the TOM Roadway. As illustrated, the top priority route then projects a merge onto a second roadway, i.e., the JON Roadway, via ramp 1106. Thereafter, the example top priority route plan projects a merge onto a third roadway, i.e., the PTE Roadway, via ramp 1108. Finally, the exit station 1104 is illustrated adjacent to the third roadway, i.e., the PTE Roadway.

Further, according to the illustrated embodiment, the top priority route plan may comprise three segments, roughly corresponding to travel along the three roadways projected for the top priority route plan. That is, the top priority route plan may include a first segment 1110, a second segment 1112, and a third segment 1114.

By way of further example, in one embodiment a vehicle may enter a diagnostics position at the entry station 1102. For this example, the vehicle may enter a diagnostic position at the entry station 1102 on 17 Jan. 2010 at 1:00 pm (i.e., 1300:00:00). Diagnostics may be run for precisely 30 seconds, i.e., from 1300:00:00 to 1300:30:00. During that time, multiple route plans may be built by a local segment routing computer, i.e., from 1300:00:00 to 1300:30:00.

As described above, a top priority route plan may be isolated by the local area monitoring computer based on the lowest estimated travel time to the selected destination. Based on the top priority route plan, according to an embodiment, a first available route time slot may be selected that corresponds with an actual time slot that will pass the entry station 40 seconds in the future. For example, the 40 second period may provide 30 seconds for building one or more route plans and a 10 second buffer for launching the vehicle into a time slot corresponding to the first available route time slot. As should be appreciated, 40 seconds is not essential to the disclosed embodiment, but is selected for purposes of example only. As such, an actual time slot projected to pass the entry station at any suitable amount of time may be selected in the spirit of the present disclosure. As noted above, for purposes of example, 40 seconds may provide sufficient time to identify a FFRTS within the top priority route plan, or an alternate route plan if necessary, and launch the vehicle into an actual time slot corresponding to the FFRTS.

FIG. 11B illustrates an embodiment of a first nine available route time slots along a first segment of the top priority route plan illustrated in FIG. 11A.

According to the illustrated embodiment, the first segment (e.g., first segment 1110) of the top priority route plan corresponds to a first roadway, i.e., the TOM Roadway.

According to some embodiments, as described above, a local segment scheduling computer may reserve a next 30 available route time slots beginning with the first available route time slot projected to pass the entry point 40 seconds in the future. According to the illustrated embodiment, only a first nine available route time slots (e.g., first nine available route time slots 1116) are shown and represented in the calculations below for purposes of clarity. As illustrated, the first nine available route time slots 1116 are numbered and represented by "dashed" representations of vehicles (e.g., first available route time slot 1124). Alternatively, occupied time slots 1118 are not numbered and are represented as "solid" representations of vehicles. Additionally, according to the illustrated embodiment, a vehicle 1120 is represented on an entry ramp 1122 of the entry station 1102. As described further herein, the first nine available route time slots 1116 may also be referred to as an original nine available route time slots 1116.

As described previously, actual time slots along each roadway have unique identifiers based on the time that each actual time slot was created by the time slot engine at a beginning of a particular system roadway. Indeed, according to at least some embodiments, "actual" time slots may be referred to as "roadway" time slots because each actual time slot is associated with the particular roadway for which it was created. That is, according to some embodiments, the time slot identifier remains constant once an actual time slot is created, regardless of a time the actual time slot may pass the entry station. According to an embodiment, there may be two actual time slots created per second on each roadway. By way of further explanation, note that "actual" time slots each have unique identifiers, but "route time slots" are associated with a particular route and may correspond to more than one actual time slot. Route time slots may correspond to more than one actual time slot because a route may involve more than one system roadway, i.e., a route may require a merge from a first actual time slot on one roadway to a second actual time slot on another roadway.

For example, according to the illustrated embodiment, the first nine available route time slots 1116 (numbered $1^{st}$ through $9^{th}$ Route Time Slots below) along the TOM Roadway may be represented as follows:

| Route Time Slots: | Correspond to Actual Time Slots: |
|---|---|
| $1^{st}$ Route Time Slot/TOM Rdwy/Available | CO-RDWYTOM1-12450000-170110_E |
| $2^{nd}$ Route Time Slot/TOM Rdwy/Available | CO-RDWYTOM1-12450030-170110_E |
| $3^{rd}$ Route Time Slot/TOM Rdwy/Available | CO-RDWYTOM1-12450100-170110_E |
| UNAVAILABLE Route Time Slot | CO-RDWYTOM1-12450130-170110_E |
| UNAVAILABLE Route Time Slot | CO-RDWYTOM1-12450200-170110_E |
| $4^{th}$ Route Time Slot/TOM Rdwy/Available | CO-RDWYTOM1-12450230-170110_E |
| $5^{th}$ Route Time Slot/TOM Rdwy/Available | CO-RDWYTOM1-12450300-170110_E |
| $6^{th}$ Route Time Slot/TOM Rdwy/Available | CO-RDWYTOM1-12450330-170110_E |
| $7^{th}$ Route Time Slot/TOM Rdwy/Available | CO-RDWYTOM1-12450400-170110_E |

-continued

| Route Time Slots: | Correspond to Actual Time Slots: |
|---|---|
| 8th Route Time Slot/TOM Rdwy/Available | CO-RDWYTOM1-12450430-170110_E |
| UNAVAILABLE Route Time Slot | CO-RDWYTOM1-12450500-170110_E |
| 9th Route Time Slot/TOM Rdwy/Available | CO-RDWYTOM1-12450530-170110_E |

According to this embodiment, "CO" refers to the state of Colorado; "RDWYTOM1" refers to the TOM Roadway, lane 1; "12450000" refers to a time that the actual time slot was created by the time slot engine for the TOM Roadway (i.e., 1245:00:00); "170110" refers to the date (i.e., 17 Jan. 2010), and "E" refers to the direction of travel (i.e., east). As should be appreciated, any number of additional or alternative designations may be used to uniquely identify an actual time slot within the spirit of the present disclosure.

FIG. 11C illustrates an embodiment of a first merge of the first nine available route time slots from a first highway to a second highway along the top priority route plan illustrated in FIG. 11A.

According to the illustrated embodiment, the second segment (e.g., second segment 1112) of the top priority route plan corresponds to the transition from the first roadway, i.e., the TOM Roadway, to the second roadway, i.e., the JON Roadway.

As depicted in the illustrated embodiment, route time slots that were represented as available on the TOM Roadway may not remain available as vehicles merge from the TOM Roadway to the JON Roadway. For example, in the illustrated embodiment, the first available route time slot 1124 is occupied by a vehicle that was already traveling along the JON Roadway. That is, according to the evaluation of available route time slots described above, first available route time slot 1124 will be eliminated, and a local segment scheduling computer may evaluate second available route time slot 1126 to determine whether that route time slot may yield a first feasible route time slot (FFRTS). Additionally, note that third available route time slot 1128 may also be eliminated as it is projected to be occupied by a vehicle traveling on the JON Roadway.

For example, according to the illustrated embodiment, the original nine available route time slots 1116 (numbered 1st through 9th Route Time Slots below) along the JON Roadway, some of which are no longer available, may be represented as follows:

| Route Time Slots: | Correspond to Actual Time Slots: |
|---|---|
| 1st Route Time Slot/JON Rdwy/UNAVAILABLE | CO-RDWYJON1-12330000-170110_N |
| 2nd Route Time Slot/JON Rdwy/Available | CO-RDWYJON1-12330030-170110_N |
| 3rd Route Time Slot/JON Rdwy/UNAVAILABLE | CO-RDWYJON1-12330100-170110_N |
| UNAVAILABLE Route Time Slot | CO-RDWYJON1-12330130-170110_N |
| UNAVAILABLE Route Time Slot | CO-RDWYJON1-12330200-170110_N |
| 4th Route Time Slot/JON Rdwy/Available | CO-RDWYJON1-12330230-170110_N |
| 5th Route Time Slot/JON Rdwy/Available | CO-RDWYJON1-12330300-170110_N |

-continued

| Route Time Slots: | Correspond to Actual Time Slots: |
|---|---|
| 6th Route Time Slot/JON Rdwy/UNAVAILABLE | CO-RDWYJON1-12330330-170110_N |
| 7th Route Time Slot/JON Rdwy/UNAVAILABLE | CO-RDWYJON1-12330400-170110_N |
| 8th Route Time Slot/JON Rdwy/UNAVAILABLE | CO-RDWYJON1-12330430-170110_N |
| UNAVAILABLE Route Time Slot | CO-RDWYJON1-12330500-170110_N |
| 9th Route Time Slot/JON Rdwy/Available | CO-RDWYJON1-12330530-170110_N |

According to this embodiment, "CO" refers to the state of Colorado; "RDWYJON1" refers to the JON Roadway, lane 1; "12330000" refers to a time that the actual time slot was created by the time slot engine for the JON Roadway (i.e., 1233:00:00); "170110" refers to the date (i.e., 17 Jan. 2010), and "N" refers to the direction of travel (i.e., north).

According to the illustrated embodiment, the local segment scheduling computer may evaluate and determine projected available route time slots on the second segment 1112 of the top priority route plan, i.e., the JON Roadway. For example, according to the illustrated embodiment, there are only four of the original nine available route time slots 1116 that remain available on the top priority route plan (i.e., the second available route time slot 1126, the fourth available route time slot 1130, the fifth available route time slot 1132, and the ninth available route time slot 1134). For the sake of clarity, time slots along the JON Roadway that correspond with the first nine available time slots merging from the TOM Roadway are identified as 1' through 9'. Again, note that for purposes of clarity, only the first nine available route time slots 1116 of the reserved 30 available route time slots are illustrated and described.

Recall that according to at least one embodiment, actual time slots are uniquely identified based on a particular roadway and on a creation time for the actual time slot at a beginning of that particular roadway. However, note that according to some embodiments, as illustrated above, route time slots may correspond to more than one actual time slot. For example, note that the fifth available route time slot 1132 corresponds to actual time slot CO-RDWYTOM1-12450300-170110_E on the TOM Roadway, but corresponds to actual time slot CO-RDWYJON1-12330300-170110_N on the JON Roadway.

FIG. 11D illustrates an embodiment of a second merge of the first nine available route time slots from the second highway to a third highway along the top priority route plan illustrated in FIG. 11A.

According to the illustrated embodiment, the top priority route plan provides for a final transition (i.e., the third segment 1114) to the PTE Roadway adjacent to the exit station 1104. Note that the second available route time slot 1126 was rendered unavailable via a merging vehicle along the PTE Roadway.

For example, according to the illustrated embodiment, the original nine available route time slots 1116 (numbered 1st through 9th Route Time Slots below) along the PTE Roadway, some of which are no longer available, may be represented as follows:

| Route Time Slots: | Correspond to Actual Time Slots: |
|---|---|
| 1st Route Time Slot/PTE Rdwy/UNAVAILABLE | CO-RDWYPTE1-12510000-170110_E |
| 2nd Route Time Slot/PTE Rdwy/UNAVAILABLE | CO-RDWYPTE1-12510030-170110_E |
| 3rd Route Time Slot/PTE Rdwy/UNAVAILABLE | CO-RDWYPTE1-12510100-170110_E |
| UNAVAILABLE Route Time Slot | CO-RDWYPTE1-12510130-170110_E |
| UNAVAILABLE Route Time Slot | CO-RDWYPTE1-12510200-170110_E |
| 4th Route Time Slot/PTE Rdwy/UNAVAILABLE | CO-RDWYPTE1-12510230-170110_E |
| 5th Route Time Slot/PTE Rdwy/Available | CO-RDWYPTE1-12510300-170110_E |
| 6th Route Time Slot/PTE Rdwy/UNAVAILABLE | CO-RDWYPTE1-12510330-170110_E |
| 7th Route Time Slot/PTE Rdwy/UNAVAILABLE | CO-RDWYPTE1-12510400-170110_E |
| 8th Route Time Slot/PTE Rdwy/UNAVAILABLE | CO-RDWYPTE1-12510430-170110_E |
| UNAVAILABLE Route Time Slot | CO-RDWYPTE1-12510500-170110_E |
| 9th Route Time Slot/PTE Rdwy/Available | CO-RDWYPTE1-12510530-170110_E |

According to this embodiment, "CO" refers to the state of Colorado; "RDWYPTE1" refers to the PTE Roadway, lane 1; "12510000" refers to a time that the actual time slot was created by the time slot engine for the PTE Roadway (i.e., 1251:00:00); "170110" refers to the date (i.e., 17 Jan. 2010); and "E" refers to the direction of travel (i.e., east).

According to the illustrated embodiment, note that the fifth available route time slot 1132 corresponds to actual time slot CO-RDWYTOM-12450300-170110_E on the TOM Roadway, corresponds to actual time slot CO-RDWYJON-12330300-170110_N on the JON Roadway, and corresponds to CO-RDWYPTE-12510300-170110_E on the PTE Roadway.

As illustrated in the example embodiment, a FFRTS along the top priority route plan is the fifth available route time slot 1132. That is, the fifth available route time slot 1132 represents an available route time slot that is projected to reach the exit station 1104 first among the reserved available route time slots (e.g., as illustrated, the first nine available route time slots 1116). According to some embodiments, upon identifying a FFRTS, the top priority route plan is rendered an optimal route plan and the FFRTS is rendered an optimal route time slot.

According to other embodiments, where alternate route plans are available, the local segment scheduling computer may calculate a FFRTS for the alternate routes as well. That is, according to some embodiments, FFRTSs may be calculated for multiple route plans. Thereafter, the optimal route plan may be selected based on an optimal FFRTS within an evaluated route plan that projects the lowest projected travel time to the selected destination. That is, an estimated time on system roadways for each FFRTS of an evaluated route plan may be calculated based on the flow of actual time slots established by the time slot engine, i.e., a calculated exit time less a calculated launch time for each FFRTS. In addition, an estimated time from the exit station 1104 to the ultimate destination, e.g., on non-system roadways, may be estimated and added to the estimated time on system roadways. This additional time may account for a route plan that may have a lower estimated time on system roadways, but may have a higher estimated time on non-system roadways due to an exit station that is further and/or less directly accessible to the destination. The FFRTS having the lowest projected travel time to the destination may be rendered the optimal route time slot and the route plan having the optimal route time slot may be rendered the optimal route plan.

According to the illustrated embodiment, only the top priority route was evaluated for a FFRTS, i.e., the fifth available route time slot 1132, and thus for purposes of discussion below, the fifth available route time slot 1132 may be referred to interchangeably as the FFRTS or the optimal route time slot and the top priority route plan may be referred to interchangeably as the optimal route plan.

According to some embodiments, upon identifying the optimal route plan, the local segment scheduling computer may schedule the optimal route plan with the master scheduling computer and may reserve the optimal route time slot on the master scheduling computer for the optimal route. That is, the master scheduling computer may reserve one or more actual time slots along the optimal route, each actual time slot corresponding to the optimal route time slot on a different roadway along the optimal route. The local segment scheduling computer may also release all other temporarily reserved available route time slots to the master scheduling computer.

Thereafter, according to at least some embodiments, a precise launch time may be calculated based on a projected time that an actual time slot corresponding to the optimal route time slot will pass the entry station, e.g., based on the flow of actual time slots established by the time slot engine. According to some embodiments, the calculated launch time may be relayed to a local area monitoring computer for launching the vehicle into an actual time slot on the roadway adjacent to the entry station 1102, i.e., the actual time slot corresponding to the optimal route time slot. The local segment scheduling computer may further provide route connection and merging information to one or more area monitoring computers along the optimal route. This information may include, among other things, the unique identifiers for actual time slots on each roadway corresponding to the optimal route time slot. Further, the optimal route plan and guidance information may be relayed to the vehicle's on-board computer. According to at least some embodiments, the local area monitoring computer responsible for the entry station 1102 may launch the vehicle at the calculated launch time into an actual time slot corresponding to the optimal route time slot.

As should be appreciated, evaluation of one or more route plans to determine an optimal route time slot allows for uninterrupted travel along the optimal route plan. Further, although actual time slot identifiers may use creation time to provide for unique identification, an estimated travel time, launch time, and exit time are not calculated based on actual time slot identifiers or creation time. However, this calculation may be based on a flow of actual time slots on the various roadways included in a particular route plan, i.e., as impacted by the established speed limits on the various roadways. For example, the estimated travel time may be determined based on a calculated time that the optimal route time slot, e.g., available route time slot 5 from above, will pass an entry point on the TOM Roadway until a calculated time that the optimal route time slot will reach an exit point 1136 on the PTE Roadway.

For example, according to the illustrated embodiment, a precise time for launching the vehicle may be calculated as follows:

Launch Time at Entry Point on TOM Roadway

| | |
|---|---|
| Pull into the diagnostics station | 1300:00:00 |
| Time to build route plan for top priority route (30 seconds) | 0000:30:00 |
| Buffer time to launch vehicle into FFRTS 1132 | 0000:10:00 |
| FFRTS 1132 arrives at entry point* | 0000:03:00 |
| Time to launch vehicle to merge with FFRTS 1132** | −0000:06:00 |
| Launch Time on Roadway System | 1300:37:00 |

*The first available route time slot 1124 was at 40 seconds after arrival on station, while the fifth available route time slot 1132 occurred three seconds later.
**The vehicle should leave the diagnostic station early enough to match speed with approaching FFRTS 1132 at the merger point.

For example, according to the illustrated embodiment, a precise time for exiting the vehicle may be calculated as follows:

Exit Time from Roadway System at Exit Point on PTE Roadway

| | |
|---|---|
| FFRTS 1132 arrives at exit point 1136 | 1324:45:00 |
| Deceleration to stop at exit station 1104 | 0000:05:00 |
| Exit Time from Roadway System | 1324:50:00 |

For example, according to the illustrated embodiment, an estimated travel time on the system roadways may be calculated as follows:

Estimated Travel Time on Roadway System

| | |
|---|---|
| Exit Time from Roadway System | 1324:50:00 |
| Launch Time onto Roadway System | −1300:37:00 |
| Estimated Travel Time on Roadway System | 0024:13:00 |

That is, according to the illustrated embodiment, after arriving at the diagnostic position at the entry station 1102 at 1:00 pm, the vehicle is projected to exit the roadway system at 1324:13:00 (approximately 1:25 pm) from the exit point 1136. The estimated travel time for the optimal route plan, then, is just over 24 minutes. Note that the estimated travel time on system roadways may not be equivalent to the projected travel time to a selected destination used to prioritize route plans and/or evaluate a FFRTS, as described above.

Actual Time Slot Embodiment

Figure 12:
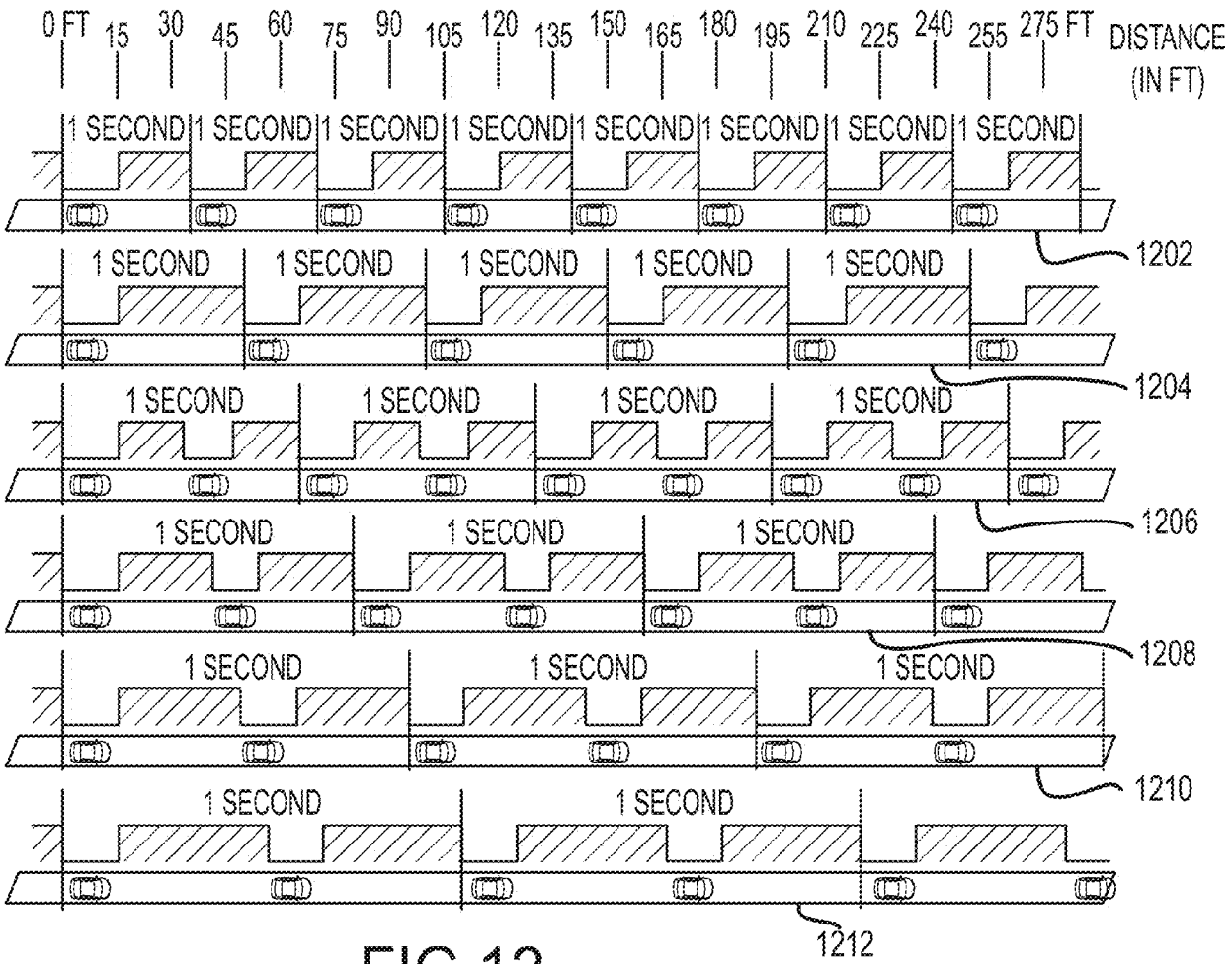
FIG. 12 is a diagram of an embodiment illustrating relative actual time slot sizes at different speed limits along system roadways.

FIG. 12 is a diagram of an embodiment illustrating relative actual time slot sizes at different speed limits along system roadways.

As described above, actual and route time slots may be employed by embodiments of the present methods to route and manage vehicles traveling on system roadways. Time slots may be referred to herein as "actual" time slots and "route" time slots. Actual time slots are defined by the time slot engine and are uniquely identified by their creation time on a particular roadway. Actual time slots may vary in size based on the flow of actual time slots on the particular roadway, which may also be dictated by the time slot engine. Alternatively, route time slots correspond to a set of time slots flowing through a particular route plan. Route time slots correspond, or map, to actual time slots; however, as a route plan may require travel on more than one roadway, route time slots may correspond to more than one actual time slot. That is, a route time slot may correspond with an actual time slot on each roadway included in a complete route plan. For example, a route time slot may correspond to a first actual time slot on a first roadway and to a second actual time slot on a second roadway. Indeed, according to embodiments, each time a route plan includes a merge from a first roadway to a second roadway, route time slots merge from first actual time slots on the first roadway to second actual time slots on the second roadway.

Specifically, actual time slots may be in embodiments based on a pattern of time over distance. As such, in embodiments a length of each actual time slot may be determined by the speed that vehicles are traveling along a particular stretch of roadway. For the sake of example, a vehicle length may be consistent for each system vehicle and may be set to 15 feet. The length of each unique actual time slot may be based on the distance that a vehicle will travel in a one second period of time. For speeds from zero to 45 miles per hour (mph), only one vehicle (one actual time slot) may be available for the one second distance that the vehicle will travel (e.g., example time/distance projection 1202 and example time/distance projection 1204). At 45 miles per hour and faster, two vehicles (two actual time slots) may be available for the one second distance that a vehicle will travel (e.g., example time/distance projections 1206 through example time/distance projection 1212). While normal stopping distance increases with an increase in speed, the system roadway system may safely control two vehicles within the one second travel distance at the higher speeds.

For example, according to some embodiments, the time slot engine may create actual time slots for each roadway on the system. An actual time slot flow along each roadway allows the system to predict a precise time that a particular actual time slot will be at a particular location along a roadway. According to embodiments, the actual time slot flow, which is based on the established speed limit for each stretch of a roadway, provides the system with a mechanism for merging vehicles from one roadway to another or for entering and exiting vehicles from the system roadways. For example, Table II below illustrates an embodiment of a model for predicting a precise time that each actual time slot will pass a specific roadway sensor along a particular roadway. The illustrated model utilizes the exact creation time for each actual time slot along the particular roadway, the established speed limit of the particular roadway, and the distance between the specific roadway sensors to determine a predicted location for each actual time slot at any one time. Thereafter, when a vehicle that is occupying an actual time slot is sensed by a specific roadway sensor, the precise actual time that the vehicle passes the specific roadway sensor may be transmitted to the time slot engine, or other component, to verify the model's accuracy in predicting the actual time slot's location over the specific roadway sensor.

TABLE II

| Time Sensor No. | 0000:01:00 Time Slot No. | 0000:02:30 Time Slot No. | 0034:01:00 Time Slot No. |
|---|---|---|---|
| S 1 | TS 3 | TS 6 | TS 4083 |
| | TS 2 | TS 5 | TS 4082 |
| S 2 | TS 1 | TS 4 | TS 4081 |
| | | TS 3 | TS 4080 |
| S 3 | | TS 2 | TS 4079 |
| | | TS 1 | TS 4078 |
| | | | * * * |

TABLE II-continued

| Time Sensor No. | 0000:01:00 Time Slot No. | 0000:02:30 Time Slot No. | 0034:01:00 Time Slot No. |
|---|---|---|---|
| S 2041 | | | TS 3 |
| | | | TS 2 |
| S 2042 | | | TS 1 |

As described above, the distance between vehicles may be maintained by a local area monitoring computer by issuing commands to system vehicles to accelerate and/or decelerate based on feedback from the roadway sensors. Additionally, as described above, proximity sensors on the vehicles may provide an additional feedback loop to prevent vehicles from getting too close to one another on the roadway.

Figure 13:
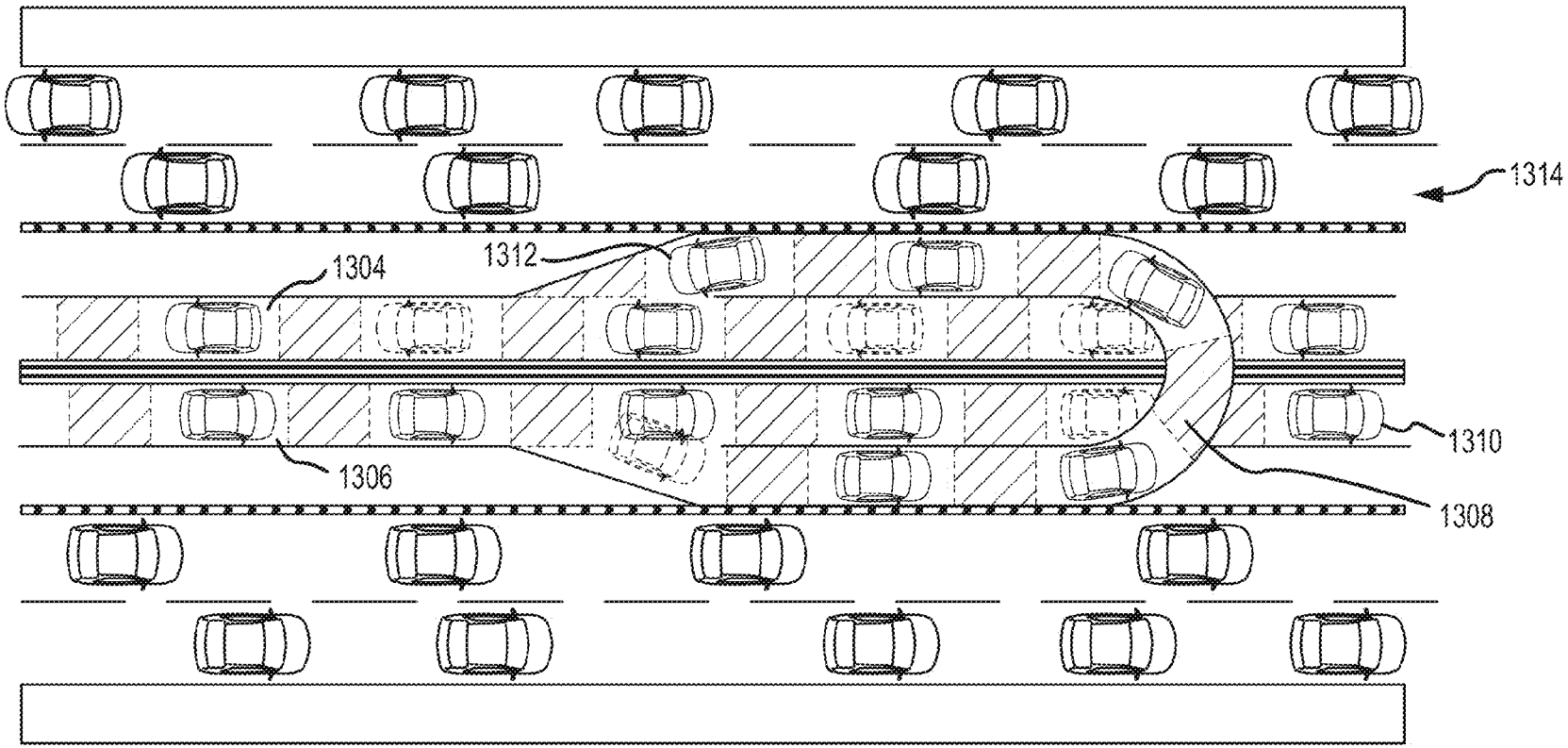
FIG. 13 is a diagram illustrating a system roadway having one or more actual time slots, consistent with an embodiment.

FIG. 13 is a diagram illustrating a system roadway having one or more actual time slots, consistent with an embodiment.

As has been previously described, defining interlinked actual time slots across the entire system roadway may be utilized by the central-command computers to synchronize and manage the entire system.

A time slot engine may in embodiments build a schedule of all actual time slots on a system roadway 1302 (e.g., actual time slot 1304 and actual time slot 1306), adjusting for speed limitations on each section of roadway, transition access ramps and merging points, loop-backs, and exit stations. The movement and scheduling of actual time slots 1304 and 1306 may be dependent upon designated speed limits for each area. Additionally, any slowdowns or obstructions on the system roadway 1302 may be monitored, managed, and scheduled by the central-command computers in order to keep the system running efficiently and smoothly across the entire network.

The actual time slots established by the time slot engine in embodiments determine the flow of traffic on the system roadway 1302. Each of the actual time slots (e.g., actual time slot 1304 and actual time slot 1306) may have a unique ID that is used to establish an optimal route plan for each vehicle (e.g., system vehicle 1310). Since actual time slots may be created by the time slot engine for the entire network, they may be calculated to provide smooth and efficient transition of each vehicle from one roadway to another.

System roadway sensors 1308 may monitor the availability of each of the actual time slots (e.g., actual time slot 1304 and actual time slot 1306) as a positive feedback loop to the central-command computers. According to embodiments, the available actual time slots along system roadway 1302 should generally match available route time slots as predicted by a vehicle's route plan. In the case where the available actual time slots do not match the projected available route time slots, a vehicle that is scheduled for launching into an unavailable actual time slot (e.g., system vehicle 1312) may be moved temporarily off the system roadway 1302 by, for example, a local area monitoring computer and an immediate route re-plan may be built for that vehicle. Even so, the rest of the vehicle traffic should generally move along as planned and, while it may be inconvenient for the delayed vehicle's operator, safety for all vehicles is a primary consideration. When the route re-plan is complete, the system vehicle 1312 may be accelerated and merged back onto the system roadway 1302 into a newly assigned actual time slot.

Networking Embodiment

According to some embodiments, an optimal design should have the highest number of vehicles on the system roadway 1302, while minimizing wait time for individual vehicle operators. However, even with a high density and flow of vehicles on the system roadways, vehicles and their operators may be maintained at a comfortable distance from one another.

By addressing each system vehicle 1310 (i.e., providing a unique identification number for each vehicle), central-command computers may track individual vehicle performance data and may monitor the projected versus actual traffic flow of vehicles. The ability to address each system vehicle 1310 may also in embodiments permit the system to identify emergency or priority vehicles that may need to move faster through the system than other vehicles. Priority vehicles needing to overtake other vehicles on the system roadway 1302 may need to be launched ahead into other available actual time slots, while the other vehicles may be moved to adjacent available actual time slots within parallel lanes, as described with reference to FIG. 10. In some embodiments, launching priority vehicles ahead may involve accelerating the priority vehicle to align it with the precise timing schedule of the new actual time slot. In the alternative, when non-priority vehicles are relocated to adjacent lanes, the relative speed of a priority lane having one or more priority vehicles may be increased relative to adjacent lanes. In this case, moving priority vehicles forward within available actual time slots may not be necessary as the entire stream of actual time slots within the priority lane may be traveling at an increased speed.

Although control of the system vehicles 1310 on the system may be generally governed by central-command computers, operators may in embodiments be able to disengage system control in order to negotiate problem areas, such as a vehicle breakdown on the roadway or in the event of system failure. Operators may also in embodiments be able to re-engage system control once the problem has been cleared.

Load Balancing Embodiment

According to embodiments of the present system, entry points may be used to regulate the traffic on the system roadway 1302. That is, through computer tracking of vehicle flow, including speed-control capabilities, the system may integrate new vehicles into the traffic flow. Loop-backs may also be designed to control the flow of traffic and to keep vehicles moving while guiding them into an appropriate direction for their destination. In some instances, the computers on the system may slow the entire traffic flow in order to keep traffic running efficiently throughout the network.

For example, an optimum speed on the system roadway 1302 may be 65 miles per hour (mph). However, the actual time slots and the system roadways may be designed to flow at the established speed limits for each section of a traditional highway. For example, some stretches of the traditional highway 1314 may be regulated at 55 miles per hour (mph) and the system roadway 1302 may also be required to operate at the same or similar established speed limit. This functionality allows for safety and other regulations to easily and efficiently be incorporated within the disclosed system.

Specifically, as described above, system roadway 1302 may be designed with entry stations having entry points for merging vehicles into the traffic flow at allocated actual time slots. The merging vehicles may be controlled by system computers to synchronize traffic flow and prevent collisions while minimizing wait time at entry points. More specifically, central-command computers may determine a precise launch time and exit time for each vehicle by regulating acceleration and deceleration speeds at the entry and exit stations. In some embodiments, personnel at a central-command center may monitor the flow of the system, but determining optimum times for entry and/or transition on the system and controlling vehicle route planning and vehicle speeds may be primarily handled by central-command computers.

As may be appreciated, flow control at system roadway intersections may be regulated in much the same way as the flow of traffic described at the merger points. Using available actual time slots may effectively transition vehicles from one roadway system to another. For example, merging lanes may be provided in embodiments where two system roadways merge together. Thus, if two incoming lanes are combined into one lane, one lane may be designated as a primary lane. That is, vehicles from the incoming lane may be merged, or launched, into available actual time slots as they stream by in the primary lane. Indeed, any suitable method for merging two lanes of system vehicles into one may be utilized by the present integrated system.

While various embodiments have been described for purposes of this disclosure, various changes and modifications may be made which are well within the scope of the present invention. For example, the disclosed system may be provided in phases, or subsystems, that may provide incremental improvements to existing freeway systems. For instance, a portion of an existing freeway system, e.g., the center lanes, may be devoted to employing a portion of the disclosed integrated system and then, at a later time, additional lanes and infrastructures may be added to the integrated system. Additionally or alternatively, one or more distributed computers may be added to the integrated system in phases, such that aspects of the integrated system may be brought online at different times, e.g., computers devoted to synchronizing the movements of system vehicles may be brought online before computers devoted to diagnostic monitoring of system vehicles. Additionally or alternatively, existing electric- and hybrid-operated vehicles may be initially adapted for use in the disclosed integrated system, whereas specially-designed system vehicles may be developed and integrated into the system at a later time.

It will be clear that the systems and methods described herein are well adapted to attain the ends and advantages mentioned as well as those inherent therein. Those skilled in the art will recognize that the methods and systems within this specification may be implemented in many manners and as such is not to be limited by the foregoing exemplified embodiments and examples. In other words, functional elements being performed by a single or multiple components, in various combinations of hardware and software, and individual functions can be distributed among software applications at either the client or server level. In this regard, any number of the features of the different embodiments described herein may be combined into one single embodiment and alternate embodiments having fewer than or more than all of the features herein described are possible.

Numerous other changes or additions may be made which will readily suggest themselves to those skilled in the art and which are encompassed in the spirit of the disclosure and as defined in the appended claims.

What is claimed is:

1. A method for synchronizing traffic flow thereby reducing traffic congestion within a system roadway comprising a plurality of roadways, comprising:

receiving a route plan request from a first vehicle under manual control, the route plan request indicating an entry point and a destination;

determining a plurality of actual time slots for a first roadway adjacent to the entry point based on a vehicle size and a set speed limit, wherein the plurality of actual time slots has a flow along the first roadway based on the set speed limit;

based on the flow of the plurality of actual time slots, determining that a first actual time slot of the plurality of actual time slots is projected to pass the entry point at a particular time;

generating by one or more processing units one or more route plans based on the entry point and one or more exit points associated with the destination;

identifying a top priority route plan of the one or more route plans, wherein the top priority route plan comprises at least the first roadway and a second roadway;

identifying a plurality of route time slots along the top priority route plan;

identifying a plurality of available route time slots along the top priority route plan, wherein each available route time slot is projected to be available from the entry point to at least one of the one or more exit points along the top priority route plan, wherein identifying the plurality of available route time slots comprises:

identifying a merge point between the first roadway and the second roadway;

projecting that at least one route time slot will be occupied by a second vehicle on the second roadway at the merge point, wherein the projecting is based at least in part on route plan information for the second vehicle; and excluding the at least one route time slot from the plurality of available route time slots;

identifying a first feasible route time slot (FFRTS) that is calculated to have a lowest projected travel time from among the plurality of available route time slots, wherein the FFRTS corresponds to the first actual time slot of the plurality of actual time slots;

taking automated control of the first vehicle; and launching the first vehicle into the first actual time slot on the first roadway at the particular time.

2. The method of claim 1, wherein three or more route plans are generated in response to the route plan request.

3. The method of claim 1, wherein identifying the top priority route plan of the one or more route plans further comprises:

calculating a projected travel time for each of the one or more route plans, wherein the projected travel time is an estimated time from the entry point to the destination;

identifying one of the one or more route plans having a lowest projected travel time; and designating the identified one of the one or more route plans as the top priority route plan.

4. The method of claim 3, further comprising:

designating a remainder of the one or more route plans not having the lowest projected travel time as alternative route plans; and determining that the projected travel time of at least one of the alternative route plans is within 25 percent of the top priority route plan, wherein the at least one alternative route plan is a feasible alternative route plan.

5. The method of claim 1, wherein identifying the plurality of available route time slots along the top priority route plan further comprises:

identifying a plurality of actual time slots corresponding to the plurality of route time slots along the top priority route plan;

determining that one or more of the plurality of actual time slots is occupied by a vehicle;

eliminating each of the plurality of route time slots corresponding to an occupied actual time slot; and determining that remaining route time slots of the plurality of route time slots are the plurality of available route time slots.

6. The method of claim 1, wherein identifying the first feasible route time slot (FFRTS) from among the plurality of available route time slots further comprises:

determining that at least one available route time slot of the plurality of available route time slots is available from the entry point to an exit point associated with the destination along the top priority route;

determining a travel time associated with the at least one available route time slot from the entry point to the destination; and determining that the at least one available route time slot having the lowest travel time to the destination is the FFRTS.

7. The method of claim 6, wherein determining the travel time associated with the at least one available route time slot further comprises:

evaluating one or more parameters comprising: current weather conditions, current traffic conditions, and projected traffic load; and determining the travel time associated with the at least one available route time slot based at least in part on evaluating the one or more parameters.

8. A system for synchronizing traffic flow thereby reducing traffic congestion within a system roadway comprising a plurality of roadways, comprising:

at least one processing unit; and at least one memory, communicatively coupled to the at least one processing unit and containing instructions that, when executed by the at least one processing unit, perform a method, comprising:

receiving a route plan request from a first vehicle under manual control, the route plan request indicating an entry point and a destination;

determining a plurality of actual time slots for a first roadway adjacent to the entry point based on a vehicle size and a set speed limit, wherein the plurality of actual time slots has a flow along the first roadway based on the set speed limit;

based on the flow of the plurality of actual time slots, determining that a first actual time slot of the plurality of actual time slots is projected to pass the entry point at a particular time;

generating one or more route plans based on the entry point and one or more exit points associated with the destination;

identifying a top priority route plan of the one or more route plans, wherein the top priority route plan comprises at least the first roadway and a second roadway;

identifying a plurality of route time slots along the top priority route plan;

identifying a plurality of available route time slots along the top priority route plan, wherein each available route time slot is projected to be available from the entry point to at least one of the one or more exit points along the top priority route plan, wherein identifying the plurality of available route time slots comprises:

identifying a merge point between the first roadway and the second roadway;

projecting that at least one route time slot will be occupied by a second vehicle on the second roadway at the merge point, wherein the projecting is based at least in part on route plan information for the second vehicle; and excluding the at least one route time slot from the plurality of available route time slots;

identifying a first feasible route time slot (FFRTS) that is calculated to have a lowest projected travel time from among the plurality of available route time slots, wherein the FFRTS corresponds to the first actual time slot of the plurality of actual time slots;

taking automated control of the first vehicle; and launching the first vehicle into the first actual time slot on the first roadway at the particular time.

9. The system of claim 8, wherein three or more route plans are generated in response to the route plan request.

10. The system of claim 8, wherein identifying the top priority route plan of the one or more route plans further comprises:

calculating a projected travel time for each of the one or more route plans, wherein the projected travel time is an estimated time from the entry point to the destination;

identifying one of the one or more route plans having a lowest projected travel time; and designating the identified one of the one or more route plans as the top priority route plan.

11. The system of claim 10, further comprising:

designating a remainder of the one or more route plans not having the lowest projected travel time as alternative route plans; and determining that the projected travel time of at least one of the alternative route plans is within 25 percent of the top priority route plan, wherein the at least one alternative route plan is a feasible alternative route plan.

12. The system of claim 8, wherein identifying the plurality of available route time slots along the top priority route plan further comprises:

identifying a plurality of actual time slots corresponding to the plurality of route time slots along the top priority route plan;

determining that one or more of the plurality of actual time slots is occupied by a vehicle;

eliminating each of the plurality of route time slots corresponding to an occupied actual time slot; and determining that remaining route time slots of the plurality of route time slots are the plurality of available route time slots.

13. The system of claim 8, wherein identifying the first feasible route time slot (FFRTS) from among the plurality of available route time slots further comprises:

determining that at least one available route time slot of the plurality of available route time slots is available from the entry point to an exit point associated with the destination along the top priority route;

determining a travel time associated with the at least one available route time slot from the entry point to the destination; and determining that the at least one available route time slot having the lowest travel time to the destination is the FFRTS.

14. The system of claim 13, wherein determining the travel time associated with the at least one available route time slot further comprises:

evaluating one or more parameters comprising: current weather conditions, current traffic conditions, and projected traffic load; and determining the travel time associated with the at least one available route time slot based at least in part on evaluating the one or more parameters.

15. A computer storage medium, having computer-readable instructions stored thereon for synchronizing traffic flow thereby reducing traffic congestion within a system roadway comprising a plurality of roadways, performing a method comprising:

receiving a route plan request from a first vehicle under manual control, the route plan request indicating an entry point and a destination;

determining a plurality of actual time slots for a first roadway adjacent to the entry point based on a vehicle size and a set speed limit, wherein the plurality of actual time slots has a flow along the first roadway based on the set speed limit;

based on the flow of the plurality of actual time slots, determining that a first actual time slot of the plurality of actual time slots is projected to pass the entry point at a particular time;

generating one or more route plans based on the entry point and one or more exit points associated with the destination;

identifying a top priority route plan of the one or more route plans, wherein the top priority route plan comprises at least the first roadway and a second roadway;

identifying a plurality of route time slots along the top priority route plan;

identifying a plurality of available route time slots along the top priority route plan, wherein each available route time slot is projected to be available from the entry point to at least one of the one or more exit points along the top priority route plan, wherein identifying the plurality of available route time slots comprises:

identifying a merge point between the first roadway and the second roadway;

projecting that at least one route time slot will be occupied by a second vehicle on the second roadway at the merge point, wherein the projecting is based at least in part on route plan information for the second vehicle; and excluding the at least one route time slot from the plurality of available route time slots;

identifying a first feasible route time slot (FFRTS) that is calculated to have a lowest projected travel time from among the plurality of available route time slots, wherein the FFRTS corresponds to the first actual time slot of the plurality of actual time slots;

taking automated control of the first vehicle; and launching the first vehicle into the first actual time slot on the first roadway at the particular time.

16. The computer storage medium of claim 15, wherein identifying the top priority route plan of the one or more route plans further comprises:

calculating a projected travel time for each of the one or more route plans, wherein the projected travel time is an estimated time from the entry point to the destination;

identifying one of the one or more route plans having a lowest projected travel time; and designating the identified one of the one or more route plans as the top priority route plan.

17. The computer storage medium of claim 16, further comprising:

designating a remainder of the one or more route plans not having the lowest projected travel time as alternative route plans; and determining that the projected travel time of at least one of the alternative route plans is within 25 percent of the top priority route plan, wherein the at least one alternative route plan is a feasible alternative route plan.

18. The computer storage medium of claim 15, wherein identifying the plurality of available route time slots along the top priority route plan further comprises:

identifying a plurality of actual time slots corresponding to the plurality of route time slots along the top priority route plan;

determining that one or more of the plurality of actual time slots is occupied by a vehicle;

eliminating each of the plurality of route time slots corresponding to an occupied actual time slot; and determining that remaining route time slots of the plurality of route time slots are the plurality of available route time slots.

19. The computer storage medium of claim 15, wherein identifying the first feasible route time slot (FFRTS) from among the plurality of available route time slots further comprises:

determining that at least one available route time slot of the plurality of available route time slots is available from the entry point to an exit point associated with the destination along the top priority route;

determining a travel time associated with the at least one available route time slot from the entry point to the destination; and determining that the at least one available route time slot having the lowest travel time to the destination is the FFRTS.

20. The computer storage medium of claim 19, wherein determining the travel time associated with the at least one available route time slot further comprises:

evaluating one or more parameters comprising: current weather conditions, current traffic conditions, and projected traffic load; and determining the travel time associated with the at least one available route time slot based at least in part on evaluating the one or more parameters.

* * * * *